US006082233A

United States Patent [19]

Han

[11] Patent Number: 6,082,233

[45] Date of Patent: Jul. 4, 2000

[54] FASTENER HOLDING DEVICE

[76] Inventor: Ki Su Han, 2249 Lerona Ave., Rowland Heights, Calif. 91748

[21] Appl. No.: 09/131,533

[22] Filed: Aug. 10, 1998

Related U.S. Application Data

[63] Continuation-in-part of application No. 08/667,653, Jun. 21, 1996, Pat. No. 5,791,212.

[51] Int. Cl.[7] ..... B25B 23/10

[52] U.S. Cl. ..... 81/453; 81/457

[58] Field of Search ..... 81/451–458, 429

[56] References Cited

U.S. PATENT DOCUMENTS

| | | | |
|---|---|---|---|
| 3,244,208 | 4/1966 | McKenzie . | |
| 3,707,894 | 1/1973 | Stillwagon, Jr. | 81/125 |
| 3,739,825 | 6/1973 | Knox . | |
| 3,942,405 | 3/1976 | Wagner | 85/46 |
| 4,140,161 | 2/1979 | Russo . | |
| 4,647,260 | 3/1987 | O'Hara et al. | 408/241 |
| 4,736,658 | 4/1988 | Jore | 81/451 |
| 4,809,572 | 3/1989 | Sasaki | 81/429 |
| 5,207,127 | 5/1993 | Nick | 81/54 |
| 5,309,799 | 5/1994 | Jore | 81/451 |
| 5,682,800 | 11/1997 | Jore | 81/429 |

FOREIGN PATENT DOCUMENTS

| | | | |
|---|---|---|---|
| 1234341 | 5/1986 | U.S.S.R. | 81/451 |

*Primary Examiner*—D. S. Meislin
*Attorney, Agent, or Firm*—Lee & Hong; Jonathan Y. Kang

[57] ABSTRACT

A fastener holding device is designed for use with power or hand tools. The device securely engages a fastener, such as a screw, and automatically disengages the fastener when the device is pushed against a work surface. The device includes a driving bit assembly which has a socket on one end for holding a driving bit and has a polygonally shaped portion on the other end for mounting in a power drill. The device further includes a retaining member adapted to be placed on the driving bit assembly and a sleeve member adapted to be placed on the retaining member. The retaining member can be equipped with various engaging assemblies, such as brackets, bearings and pins, to securely engage the fastener. The position of the sleeve member in relation to the retaining member allows the fastener to be either engaged or disengaged with respect to the driving bit.

18 Claims, 14 Drawing Sheets

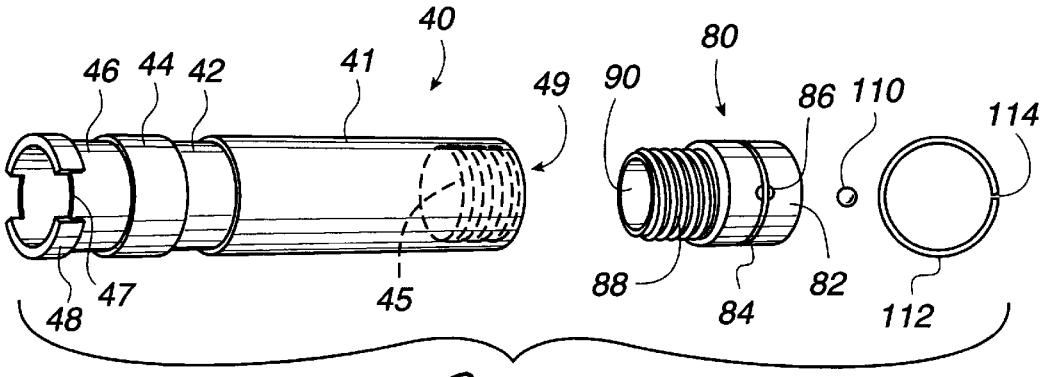
Fig. 3A
Fig. 3B
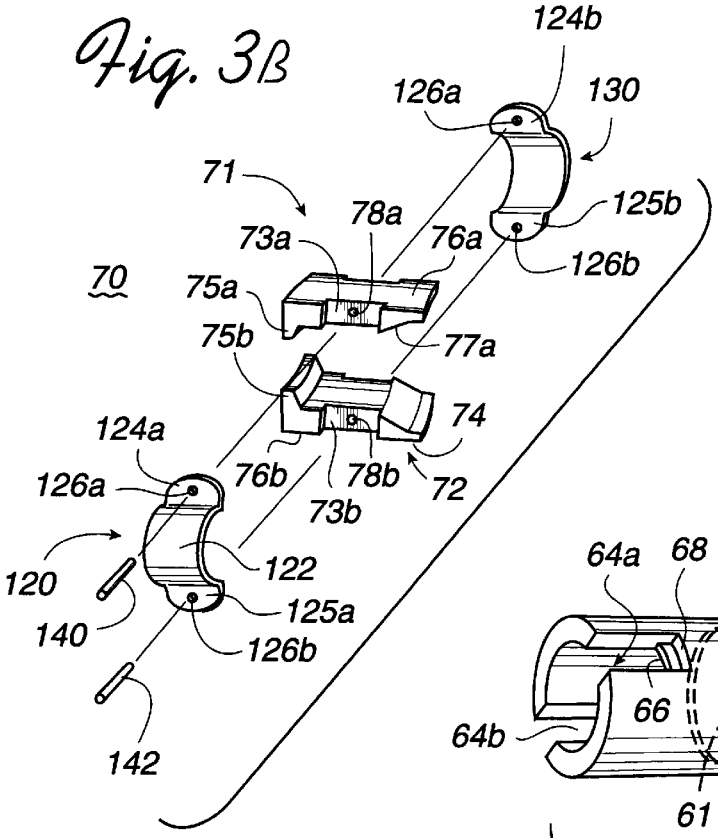
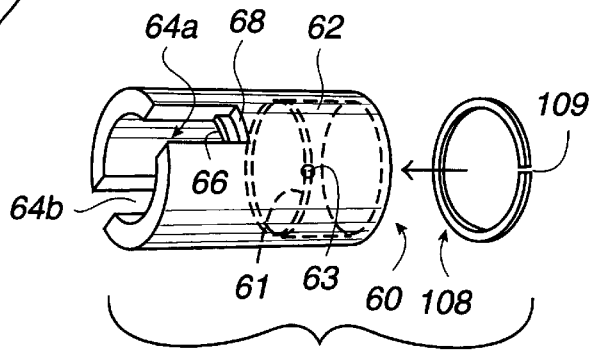
Fig. 3C

Fig. 6A
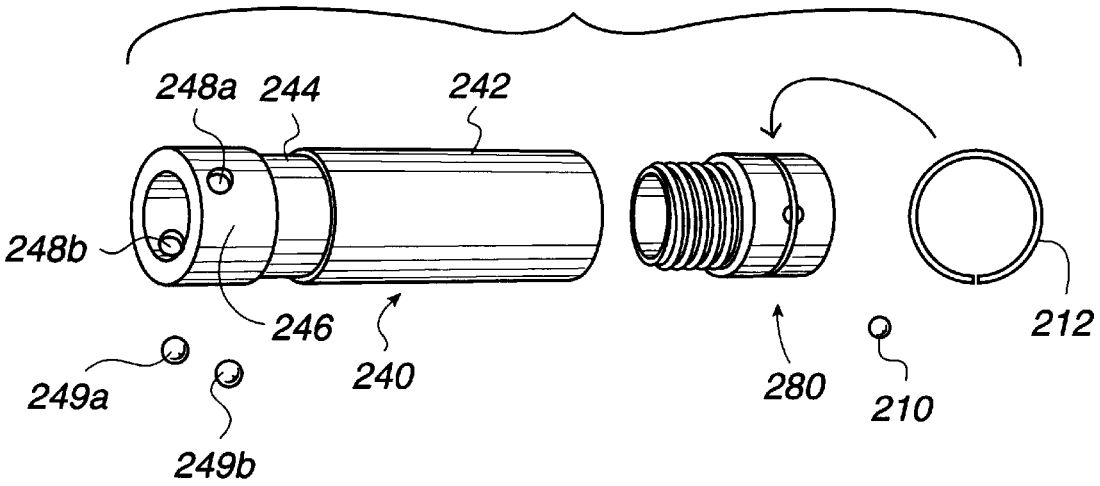
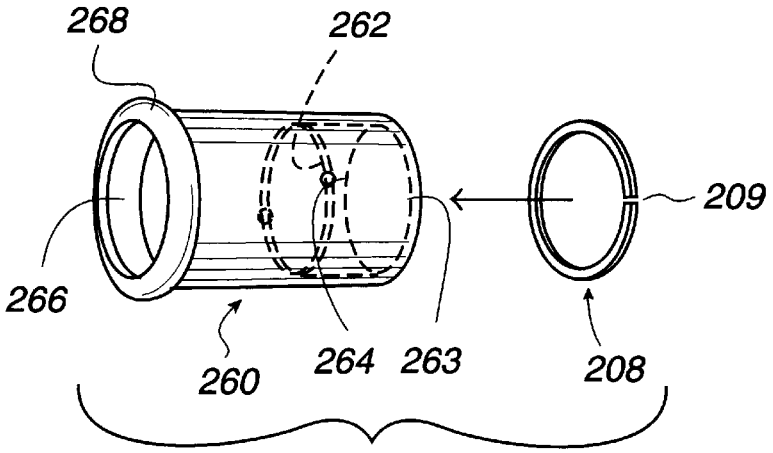
Fig. 6B

FASTENER HOLDING DEVICE

This is a continuation-in-part of application Ser. No. 08/667,653 filed on Jun. 21, 1996, now U.S. Pat. No. 5,791,212.

BACKGROUND OF THE INVENTION

1. Field of the Invention

This invention relates to a fastener holding device which holds fasteners, such as screws, securely in contact with a driving bit, and more particularly, to a fastener holding device intended for use with a powered tool.

2. Description of Related Art

Conventional screw holding and driving devices show various means for holding a screw in position while screwing the screw into a work material, such as wood. Such screw holding devices do not provide a means for securely holding a screw head with a driving bit to prevent slippage of the bit from the screw head. In addition, some screw holding devices provide an elongated sleeve around the driving bit to hold the screw therein. To use such screw holding devices, an operator must apply substantial pressure on the screwdriver handle to force the screw into a work material. Such pressure can result in a penetration of a screw at an offset angle.

For some fastener application, washers of various types are used with the screw prior to driving the fastener into the work material. In a typical application, a washer is premounted on a screw and positioned adjacent to the head of the screw. However, if a conventional screw holding device using an elongated sleeve is used, the placement of a washer adjacent to the head of the screw is not possible.

In addition, the conventional screw holding device using a sleeve to hold a screw typically uses a magnetized driving bit to prevent the screw from falling out from the sleeve. Such a magnetic driving bit cannot hold the screw substantially perpendicularly with respect to the work material if the screw is sufficiently heavy (e.g., when using a larger screw). Even if the magnetic driving bit can initially hold the screw perpendicularly with respect to the work material, the driving bit has very poor holding power, and as a result the screw can easily tilt to an undesirable angle when uneven force is applied on the head of the screw. Moreover, when non-metal screws are used, such magnetized driving bit cannot be used, since an operator must manually hold the screw, which defeats the purpose of the fastener holding device.

SUMMARY OF THE DISCLOSURE

It is an object of the present invention to provide a fastener holding device which holds any type of screws onto a driving bit so that the screws can be driven into a work material at any desired angles. Further object of the present invention is to provide automatic release of the screw when the screw is either fully or partially embedded into a work material.

According to a first embodiment of the present invention, the fastener holding device includes a driving bit assembly having a first end and a second end, a retaining member adapted to be placed on the first end of and in surrounding relation to the driving bit assembly, an engaging assembly coupled with the retaining member for maintaining an engaging position to hold the fastener within the retaining member, and a sleeve member adapted to be placed on and in surrounding relation to the retaining member. The sleeve member maintains at least one of a first position and a second position relative to the retaining member. When the sleeve member maintains the first position, the engaging assembly engages the fastener. When the sleeve member maintains the second position, the engaging assembly disengages the fastener.

The first end of the driving bit assembly may be a socket adapted to receive a driving bit or a driving bit. The socket has a recess for holding a bit retainer. The bit retainer is coupled to the driving bit through the recess to firmly hold the driving bit within the socket. The engaging assembly includes a plurality of brackets. The plurality of brackets are pivotally positioned on to the retaining member. The sleeve member includes a groove and a plurality of recesses, in which the groove is formed on an internal surface of the sleeve member for engaging a retainer ring. Each one of the plurality of recesses is sized to be positioned in surrounding relation to each one of the plurality of brackets to allow pivoting action of the plurality of brackets. According to the first embodiment of the present invention, the retaining member further includes a neck portion, wherein the retaining ring of the sleeve member is coupled to and slides on the neck portion to maintain at least one of the first position and the second position relative to the retaining member.

The first embodiment of the present invention further includes a plug member which has a threaded portion. The retaining member includes a corresponding mating threaded portion formed on an inner surface of the retaining member for adjustably fastening with the plug member. The plug member includes a receptacle for holding a retainer bearing and a retainer groove crossing the receptacle for holding a retainer ring. The driving bit assembly includes a first groove and a second groove for positioning the retaining member on the driving bit assembly. When the retainer bearing is coupled to the second groove, the retaining member separates from the first end of the driving bit assembly.

According to a second embodiment of the present invention, the sleeve member includes a grooved member forming an enlarged opening. Moreover, the engaging assembly includes a plurality of bearings, and the retaining member includes a plurality of receptacles. Each one of the plurality of receptacles is sized to hold each one of the plurality of bearings so that part of the each one of the plurality of bearings protrudes through an inner surface of the retaining member to engage the fastener.

According to a third embodiment of the present invention, the engaging assembly may include a plurality of pins and the retaining member having a plurality of receptacles for holding each one of the plurality of pins so that part of the each one of the plurality of pins protrudes through an inner surface of the retaining member to engage the fastener.

According to a fourth embodiment of the present invention, the sleeve member has a plurality of protrusions and a slit. The engaging assembly includes a plurality of bearings, and the retaining member has a plurality of receptacles and a control pin. Each one of the plurality of receptacles is sized to hold each one of the plurality of bearings so that part of the each one of the plurality of bearings protrudes through an inner surface of the retaining member. The control pin is positioned within the slit to limit the movement of the sleeve member relative to the retaining member. The retaining member engages the fastener when the sleeve member is at the first position and disengages the fastener when the sleeve member is at the second position.

According to still another embodiment of the present invention, a fastener holding device has a driving bit assembly having a first end and a second end, wherein the second end is polygonally shaped and the first end having a first inclined member on an outer circumference of the driving bit assembly. A retaining member of the present device is adapted to be placed on the first end of and in surrounding relation to the driving bit assembly. The retaining member includes a plurality of receptacles and a plurality of slots to hold a plurality of brackets. Each one of the plurality of brackets includes a head portion, a body portion, and a leg portion. Each one of the plurality of receptacles in the retaining member is sized and configured to hold each one of the plurality of brackets. Similarly, each one of the plurality of slots in the retaining member is sized to hold the leg portion of the plurality of brackets. A sleeve member configured to be placed on and in surrounding relation to the retaining member. The sleeve member includes a plurality of recesses, wherein each one of the plurality of recesses is configured to encase the head portion of the plurality of brackets. The sleeve member maintains either a first position or a second position relative to the retaining member. The engaging assembly engages the fastener when the sleeve member is at the first position and disengages the fastener when the sleeve member is at the second position. A plug which is coupled to the retaining member has a second inclined member which abuts against the first inclined member of the driving bit assembly to adjust the placement of the retaining member in relation to the driving bit assembly to accommodate fasteners having different head thicknesses.

According to another embodiment of the present invention, the fastener holding device has a retaining member which has oppositely disposed clamps extending from the retaining member for releasably holding the fastener and a sleeve member configured to be placed on and in surrounding relation to the retaining member, in which the sleeve member has a plurality of recesses formed in a forward end of the sleeve member. Each one of the clamps includes a leg extending from the retaining member and a hook for engaging the fastener. The legs are radially biased so that they are diversing from the center of the retaining member. Each one of the plurality of recesses is configured to retain the clamps. The sleeve member maintains at least one of a first position and a second position relative to the retaining member, in which the clamps engage the fastener when the sleeve member is at the first position and disengages the fastener when the sleeve member is at the second position.

According to one aspect of the present invention, the fastener holding device further includes a first end piece placed against and rotating with the driving bit assembly and a second end piece placed against the first end piece. The first end piece has an inclined surface, and the second end piece has an inclined surface which frictionally abuts against the inclined surface of the first end piece. The retaining member is coupled to the second end piece to axially move with respect to the driving bit assembly to accommodate fasteners having various head thicknesses.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

FIG. 3A is an exploded view of a retaining member according to the first embodiment of the present invention;

FIG. 3B is a bracing member according to the first embodiment of the present invention;

FIG. 3C is a sleeve member according to the first embodiment of the present invention;

FIG. 6A is an exploded view of a retaining member according to the second embodiment of the present invention;

FIG. 6B is a perspective view of a sleeve member according to the second embodiment of the present invention;

DETAILED DESCRIPTION OF THE PREFERRED EMBODIMENTS

Figure 1:
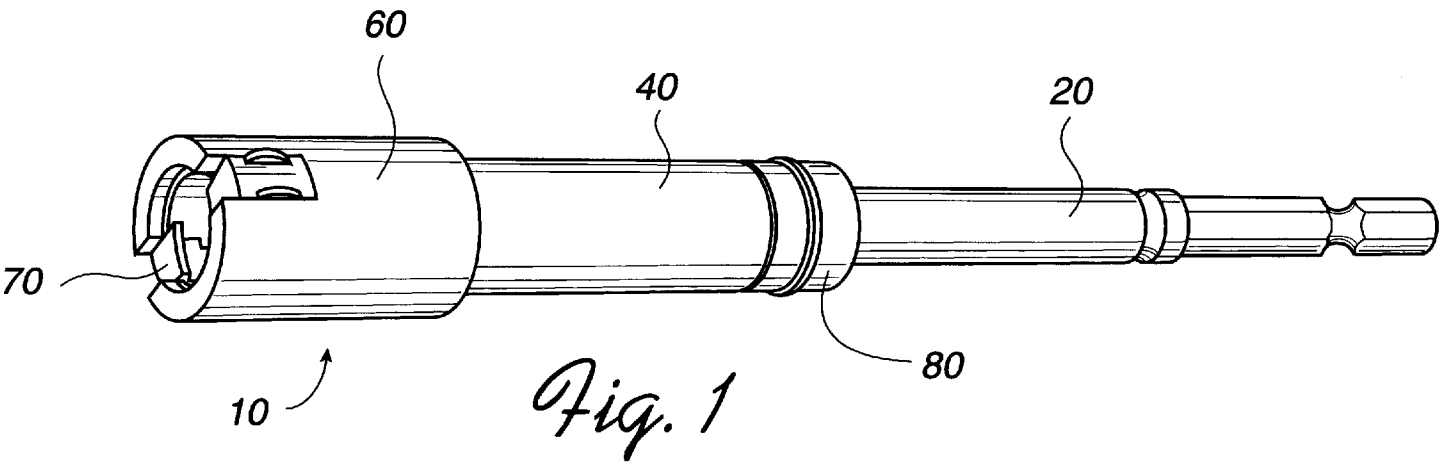
FIG. 1 is a perspective view of a first embodiment of the present invention.

A fastener holding device for holding and driving a fastener, such as a screw, into a work material according to an embodiment of the invention is shown in the drawings for purposes of illustration. Various embodiments of the fastener holding device are designed to be used with a power tool, but may also be used with hand tools, such as conventional screwdrivers. A preferred embodiment of the fastener holding device has a driving bit member, a retaining member, a bracing member and a sleeve member. A fastener, such as a screw is installed in the retaining member. The head of the screw is securely held against a driving bit with the bracing member, so that an operator does not need to hold the screw while using the driving tool.

Figure 2:
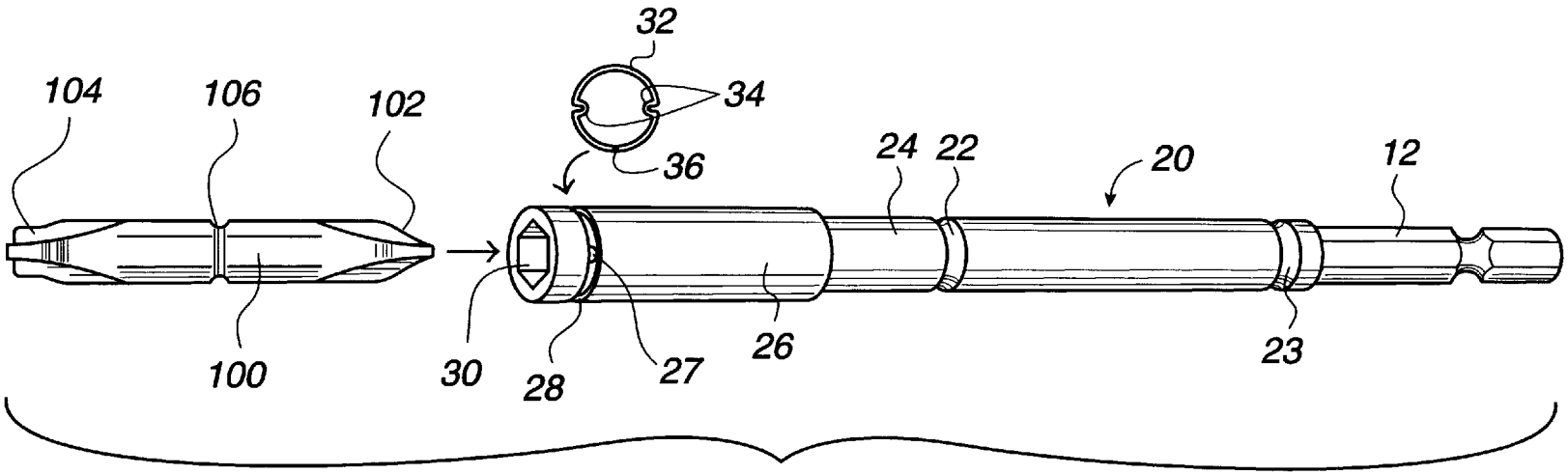
FIG. 2 shows a driving bit member and a driving bit.

FIGS. 1–4B illustrate a first embodiment of the fastener holding device 10. The first embodiment includes a driving bit member 20, a retaining member 40, an engaging assembly 70 and a sleeve member 60. The retaining member 40 is adapted to be fitted with the driving bit member 20. As shown in FIG. 2, the driving bit member 20 is an elongated cylindrical member, in which a first portion 26 is adapted to be used with a driving bit 100. An elongated middle portion 24 is axially attached to the first portion 26 and is connected to a third portion 12, thus forming the driving bit member 20.

As shown in FIG. 2, the first portion 26 has a polygonally shaped aperture 30 for receiving the driving bit 100. To hold the driving bit 100 firmly within the first portion 26 of the driving bit member 20, a retainer ring 32 is used. The retainer ring 32 is placed into a groove 28 formed circumferentially on the outer surface of the first portion 26. The groove 28 has a plurality of openings 27, preferably at the opposite ends, adapted to receive a plurality of protuberance 34 formed on the retainer ring 32. The retainer ring 32 is preferably of a ring shape and has a broken segment 36. The broken segment 36 allows the diameter of the retainer ring 32 to be enlarged for easy installation into the groove 28 of the first portion 26. As described above, the retainer ring 32 has a plurality of protuberances 34 for engaging the neck 106 of the driving bit 100 when the driving bit 100 is installed into the first portion 26. In the preferred embodiment of the present invention, the number of protuberances 34 and the number of openings 27 must be the same so that the retainer ring 32 can snugly fit into the groove 28. When the driving bit 100 is pushed into the aperture 30, the body of the driving bit 100 pushes the protuberances 34 of the retainer ring slightly outward. When the driving bit 100 is further pushed into the first portion 26, the neck 106 portion of the driving bit reaches the groove 28 of the first portion 26, thus allowing the protuberances 34 to engage the neck 106. Once the protuberances 34 engage the neck 106 of the driving bit 100, the retainer ring 32 retains its original form. The first portion 26 of the driving bit member 20 is adaptable for a rapid change of screw driver bit sizes or styles, and thus is capable of accommodating screws of a variety of sizes and head shapes. In an alternatively embodiment of the present invention, the first portion 26 and the driving bit 100 may be integrated into one component.

The middle portion 24 of the driving bit member 20 is an elongated cylindrical member which extends from the first portion 26. The middle portion 24 includes a first ring 22 and a second ring 23, in which both rings have a smaller diameter than the diameter of the middle portion 24. The purposes of the first 22 and the second rings 24 will be discussed below with regard to the retaining member 40.

The third portion 12 of the driving bit member 20 extends from the middle portion 24. The third portion 12 is of a polygonal shape around its circumferential surface and is adapted to be used with a power or hand tool. In the preferred embodiment, the first 26, the middle 24 and the third 12 portions of the driving bit member 20 may be formed together as one mold or may be formed from separate portions coupled together by welding or the like. The driving bit member 20 may be made of any rigid material, preferably a tempered steel. Similarly, the retainer rig 32 may be formed of any resilient material sufficiently elastic to allow a slight enlargement.

FIG. 3A illustrates a retaining member 40 which is adapted to be placed on the first end of and in surrounding relation to the driving bit member 20. In the preferred embodiment, the retaining member 40 is an elongated cylinder with a hollow interior. The retaining member 40 includes a collar 48 formed around one end of the retaining member 40, a first neck 46 extending from the collar 48, a first elongated body 44 extending from the first neck 46, a second neck 42 extending from the first elongated body 44, and a second elongated body 41 extending from the second neck 42. The end of the retaining member 40, opposite to the collar 48, defines an opening 49 which is adapted to receive a cylindrical plug 80. The inner surface of the opening 49 has a threaded surface 45 for mating with the plug 80. The plug 80 includes a base 82 and a threaded member 88 extended from the base 82. The outer diameter of the threaded member 88 is sized to fit within the inner threaded surface 45 of the second elongated body 41. The base 82 of the plug 80 has a circular neck 84 around the outer circumferential surface of the base 82. The plug 80 also has an aperture 86 adapted to retain a ball bearing 110. The ball bearing 110 is retained within the aperture 86 by a holding ring 112 which has the substantially the same diameter as the circular neck 84 to snugly fit around the neck 84. The holding ring 112 is made of a resilient and sufficiently elastic material, such as steel, and has a break 114 to allow a compression and expansion of the holding ring 112 so that the ball bearing 110 can be pushed in and out of the aperture 86 with sufficient resistance.

FIG. 3B illustrates various components which form an engaging assembly 70 of the fastener holding device 10 according to the first embodiment. The engaging assembly 70 includes braces 120 and 130, pins 140 and 142 and retainers 71 and 72. Preferably, each one of the braces 120 and 130 is semicircularly shaped and is adapted to be placed around the first neck 46 of the retaining member 40 shown in FIG. 3A. For example, a first brace 120 is placed immediately below one of the collars 48 of the retaining member 40. A second brace 130 is placed immediately below the other one of the collars 48, preferably, opposite to the first brace 120. When two braces 120 and 130 are placed on the first neck 26 of the retaining member 40, the holes 126a in flanges 124*a* and 124*b* and the holes 126*b* in flanges 125*a* and 125*b* line up.

According to the preferred embodiment of the present invention, a first retainer 71 has a bore 78*a* configured and sized to firmly receive the pin 140. The first retainer 71 also has a substantially perpendicular projection 75*a* which is placed against an edge 47 of the retaining member 40. The perpendicular projections 75*a* and 75*b* engage the head of a fastener, such as a screw, during operation of the present invention. The receptacle 73*a* of the first retainer 71 is sized and adapted to fit the flange 124*a* of the brace 120. As shown in FIG. 3B, there are two receptacles on the opposite side of each retainer 71. The body 76*a* of the retainer 71 is cylindrically shaped to substantially surround the outer circumference of the first neck 46 of the retaining member 40. The second retainer 72 has the symmetrical shape and features as the first retainer 71 and is placed on the opposite side of the first neck 47. When the first retainer 71 and the second retainer 72 are properly placed in between the two braces 120 and 130, the holes 126*a* and 126*b* of the braces 120 and 130 and the bores 78*a* and 78*b* line up, and pins 140 and 142 are placed into the bores 78*a* and 78*b*, respectively. The pins 140 and 142 allow the two retainers 71 and 72 to pivot toward and away from the center axis of the retaining member 40. The pins 140 and 142 are preferably made with a rigid material, such as steel.

FIG. 3C illustrates a sleeve member 60 adapted to be placed on and in surrounding relation to the retaining member 40. In the preferred embodiment, the sleeve member 60 has a body 62 which is an elongated cylinder with a hollow interior with openings on each end of the cylinder. The body's 62 inner diameter is slightly larger than the outer diameter of the retaining member 40 so that the body 62 slides and rotates easily in relation to the retaining member 40. The length of the body 62 is such that when the retaining member 40 is placed within the sleeve member 60 with the sleeve member 60 in a screw retention position (e.g., when two retainers 71 and 72 are closed toward the center axis of the retaining member 40), the sleeve member 60 extends slightly further out than the collar 48 of the retaining member 40. Around the inner circumference of the body 62 of the sleeve member 60, there is an inner groove 61. The body 62 of the sleeve member 60 has a bore 63 penetrating from the outer surface to the inner surface of the body 62 where the inner groove 61 is located. The inner groove 61 is sized and adapted to be fitted with an inner retainer ring 108. The inner retainer ring 108 is constructed of a resilient material, such as steel, and is substantially circular. The inner retainer ring 108 has a break portion 109 for easy installation into and removable from the sleeve member 60. In other words, two ends of the inner retainer ring 108 are spaced apart in the at-rest position to allow for the compression of the ring 108 along its axis. For example, when installing, the diameter of the inner retainer ring 108 can be slightly reduced due to the break portion 109. Further, to remove the inner retainer ring 108 from the inner groove 61, an object, such as a pin, may be inserted through the bore 63 to push the inner retainer ring 108 from the inner groove 61.

To install the sleeve member 60 onto the retaining member 40, the inner retainer ring 108 is placed around the second neck portion 42 of the retaining member 40. The sleeve member 60 is then slidably mounted onto the retaining member 40 until the inner retainer ring 108 fits into the inner groove 61. This construction allows the sleeve member 40 to move freely, in the axial direction, on the second neck 42 of the retaining member 40, without being separated from the retaining member 40.

As shown in FIG. 3C, the sleeve member 60 further includes two recesses 64*a* and 64*b*, in which each recess is sized to fit each retainer. For example, the recess 64*a* is sized to receive the retainer 72. The recess 64*a* has a base 68 and an extension member 66 which extends from the base 68 to form a step like structure. The purpose of this structure will be discussed below with regard to the operation of the fastener holding device.

Figure 4A:
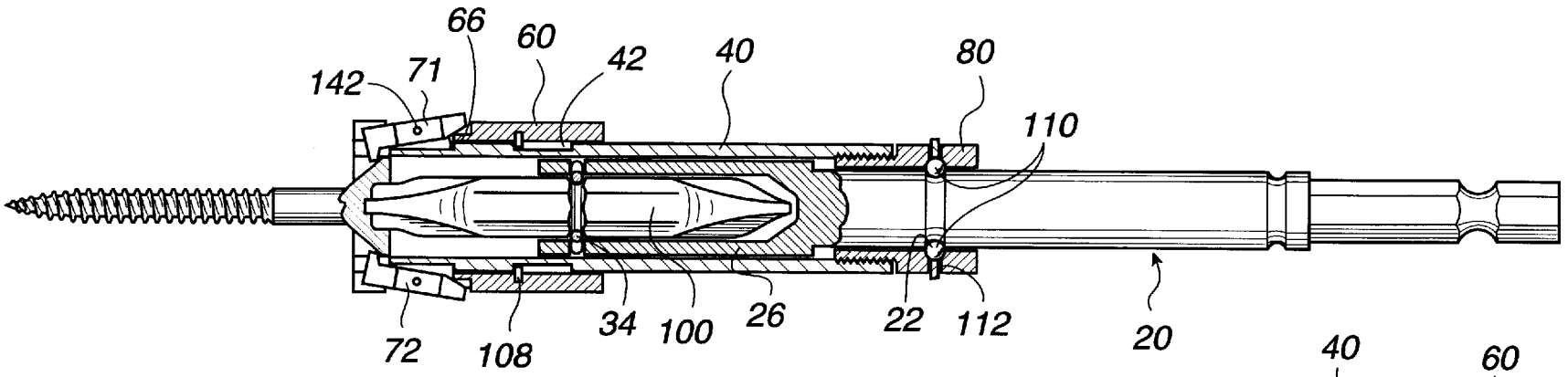
FIG. 4A is a cross-sectional view of the first embodiment of the present invention.

The operation of the fastener holding device according to the first embodiment will now be discussed. As shown in FIG. 4A, which illustrates a cross section view of the first embodiment of the fastener holding device, the protuberance 34 of the retainer ring 32 holds the driving bit 100 firmly into the first portion 26 of the driving bit member 20. The retaining member 40 is slidably coupled to the driving bit member 20 by, for example, a pair of ball bearings 110. In particular, the ball bearings 110, which are inserted into the plug 80, engage the first ring 22. The sleeve member 60 is then slidably coupled to the retaining member 40 with an inner retaining ring 108 which engages the second neck 42 of the retaining member 40.

Figure 4B:
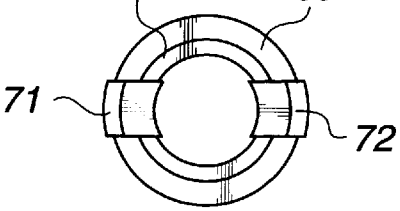
FIG. 4B is a front axial view of the first embodiment of the present invention.

To place a screw onto the driving bit 100, the sleeve member 60 is pulled back relative to the retaining member 40. When the sleeve member 60 is sufficiently pulled back with respect to the retaining member 40, the extension member 66 separates from the retainer 71. As a result, the inclined portion 77*a* of the retainer 71 can be pivoted which allows the retainer 71 to open up due to the pivoting effect created by the pin 142. The retainer 72 performs the same operation as the retainer 71. Once the screw is properly positioned on the driving bit 100, the sleeve member 60 is pushed toward the screw which in effect causes the retainers 71 and 72 to close tightly over the head of the screw, as shown in FIG. 4B. When the sleeve member 60 is installed onto the retaining member 40 and is in a fastener holding position, the inclined portion 77*a* of the retainer 71 rests against the extension member 66 of the sleeve member 60.

As the screw is drive into the work piece using the present invention, the sleeve member 60 gets closer to the work piece. When the sleeve member 60 makes a contact with the work piece, the force of the driving bit member 20 continues to drive the screw into the work piece, while the sleeve member 60 is gradually pulled backwards. The backward movement of the sleeve member 60 causes the retainers 71 and 72 to pivot away from the center axis, so that the driving bit 100 further drives the screw until the screw is completely embedded into the work piece.

Figure 5:
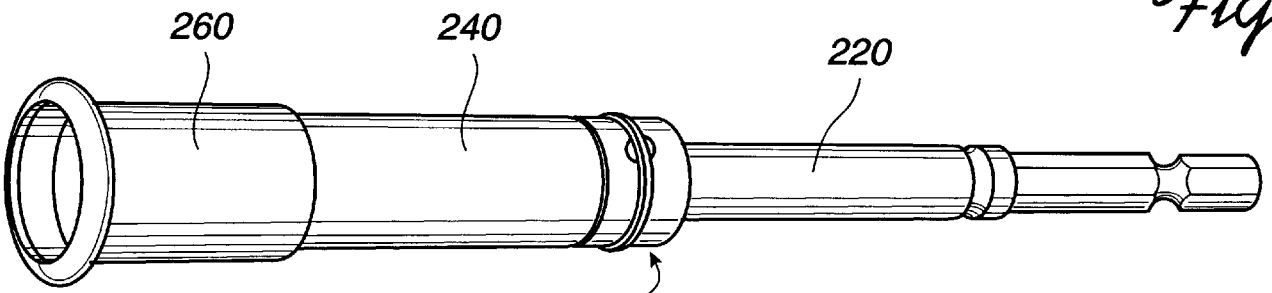
FIG. 5 is a perspective view of a second embodiment of the present invention.

FIG. 5–7B illustrate a second embodiment of the fastener holding device. FIG. 5 shows a perspective view of the second embodiment of the present invention. As shown in FIG. 5, the driving bit member 220 is identical to that of its counterpart shown in FIG. 1 and this will not be discussed again for the sake of brevity. FIG. 6A shows a retaining member 240 according to the second embodiment of the present invention. The retaining member 240 is adapted to be placed on the first end of and in surrounding relation to the driving bit member 220. The retaining member 240 forms an elongated cylinder with a hollow interior. The retaining member 240 includes a first elongated body 246, a neck 244 extending from the first elongated body 246 and a second elongated body 242 extending from the neck 244. The first elongated body 246 has at least two receptacles 248*a* and 248*b* for ball bearings 249*a* and 249*b*. The receptacles 248*a* and 248*b* are sized and configured so that the ball bearings 249*a* and 249*b*, when installed, will protrude through the opening in the inner wall of the first elongated body 246 without completely passing through the wall of the first elongated body 246. In other words, the ball bearing 249*a*, for example, can be installed only from the outside wall of the first elongated body 246.

FIG. 6A also illustrates a plug 280, a retainer ring 212 and a ball 210. The description and the operation of these elements are described above with respect to the first embodiment of the present invention.

Figure 7A:
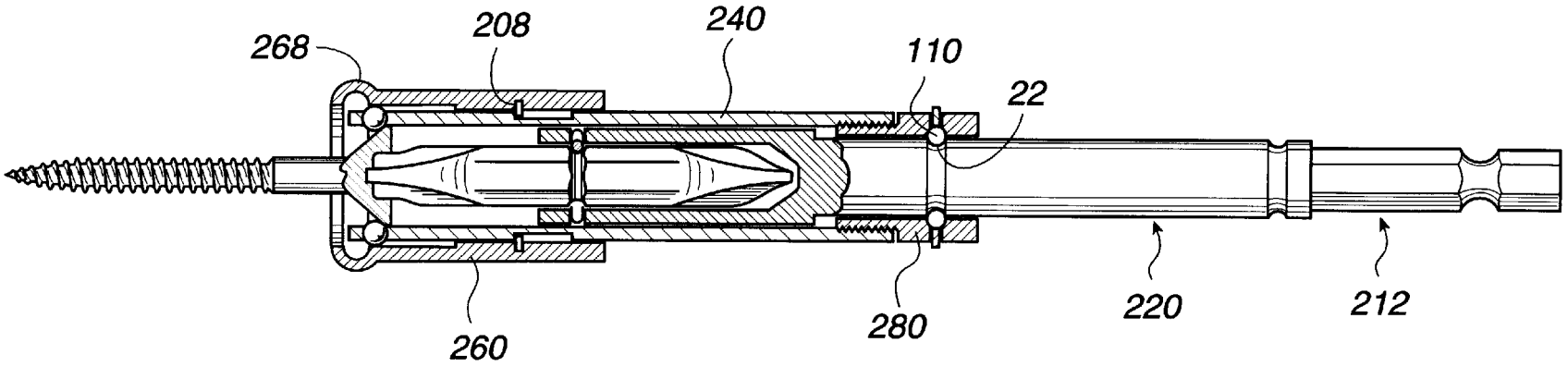
FIG. 7A is a cross-sectional view of the second embodiment of the present invention.

FIG. 6B illustrates a sleeve member 260, according to the second embodiment of the present invention, which is adapted to be placed on and in surrounding relation to the retaining member 240. The sleeve member 260 has a ring shaped member 268 and a body 263 which is an elongated cylinder with a hollow interior with openings on each end of the cylinder. The ring shaped member 268 of the sleeve member 260 is constructed on one end of the elongated body 263, which is near the receptacles 248*a* and 248*b*. The ring shaped member 268 forms a groove 266 on its interior surface which is sized to fit the ball bearings 249*a* and 249*b* when they protrude outward from the receptacles 248*a* and 248*b*. The cross-section view of the ring shaped member 268 is shown in FIG. 7A. The body's 263 inner diameter is slightly larger than the outer diameter of the retaining member 40 so that the body 263 slides and rotates easily in relation to the retaining member 40. The length of the body 263 is such that when the retaining member 240 is placed within the sleeve member 260 with the sleeve member 260 in a screw retention position, the sleeve member 260 extends slightly further out than the first elongated body 246 of the retaining member 240.

Around the inner circumference of the body 263 of the sleeve member 260, there is an inner groove 262, and a bore 264 which penetrates from the outer surface to the inner surface of the body 263 where the inner groove 264 is located. The inner groove 262 is sized and configured to be fitted with an inner retainer ring 208. The inner retainer ring 208 is constructed of a resilient and sufficiently elastic material, such as steel, and is substantially circular. The inner retainer ring 208 has a break portion 209 for easy installation into and removable from the sleeve member 260. In other words, two ends of the inner retainer ring 108 are spaced apart in the at-rest position to allow for compression of the ring 208 along its axis. For example, when installing, the diameter of the inner retainer ring 208 can be slightly reduced due to the break portion 209. Further, to remove the inner retainer ring 208 from the inner groove 262, an object, such as a pin, may be inserted through the bore 264 to push the inner retainer ring 208 from the inner groove 262.

The sleeve member 260 is slidably coupled to the retaining member 240 with an inner retaining ring 208 which engages the neck 244 of the retaining member 240. To place a screw onto a driving bit 100, the sleeve member 260 is pulled back relative to the retaining member 240. When the sleeve member 260 is sufficiently pulled back, the ring shaped member 268 is positioned substantially above the ball bearings 249*a* and 249*b* and the receptacles 248*a* and 248*b* of the retaining member 240. The position of the sleeve member 260 allows the ball bearings 249*a* and 249*b* to be pushed outward, without being completely pushed out of the respective receptacles 248*a* and 248*b*, when the screw is placed onto the driving bit 100.

The operation of the fastener holding device according to the second embodiment will now be discussed. As shown in FIG. 7A which illustrates a cross section view of the second embodiment of the fastener holding device, the retaining member 240 is slidably coupled to the driving bit member 220 by a pair of ball bearings 110. In particular, the ball bearings 110, which are mounted in the plug 80, engage the first ring 22 of the driving bit member 220. The sleeve member 260 is then slidably positioned on the retaining member 240 with an inner retaining ring 208 engaging the second neck 244 of the retaining member 240.

To place a screw onto a driving bit 100, the sleeve member 260 is pulled back relative to the retaining member 240. When the sleeve member 260 is sufficiently pulled back, the ring shaped member 268 is positioned immediately next to the ball bearings 249*a* and 249*b*. As a result, the ball bearings 249*a* and 249*b* are free to partially fall out of the receptacles 248*a* and 248*b*, allowing the screw head to be inserted onto the driving bit 100. Once the screw is properly positioned on the driving bit 100, the sleeve member 260 is pushed toward the screw which in effect causes the ball bearings 249*a* and 249*b* to firmly hold the head of the screw.

As the screw is driven into the work piece, the sleeve member 260 gets closer to the work piece. When the sleeve member 60 makes a contact with the work piece, the force of the driving bit member 220 continues to drive the screw into the work piece, while the sleeve member 260 is gradually pulled backwards. The backward movement of the sleeve member 60 causes the ball bearings 249*a* and 249*b* to drop into the groove 266 of the ring shaped member 268, thus further allowing the screw to penetrate into the work piece until the screw is completely embedded.

Figure 7B:
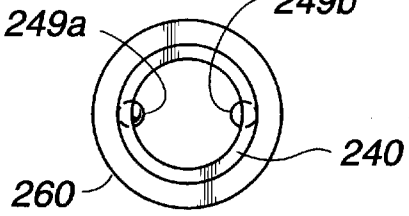
FIG. 7B is a front axial view of the second embodiment of the present invention.

FIG. 7B illustrates a front view of the fastener holding device according to the second embodiment of the present invention. The ball bearings 249*a* and 249*b* partially protrude toward the center axis of the retaining member 240. This construction allows the screw to be held in between the ball bearings 249*a* and 249*b*.

Figure 8:
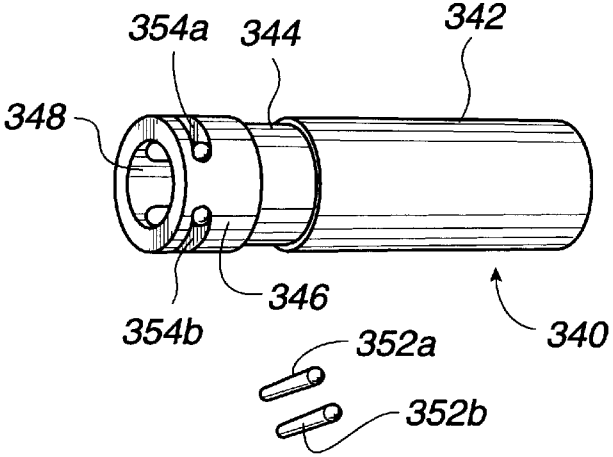
FIG. 8 is a perspective view of a retaining member according to a third embodiment of the present invention.
Figure 9B:
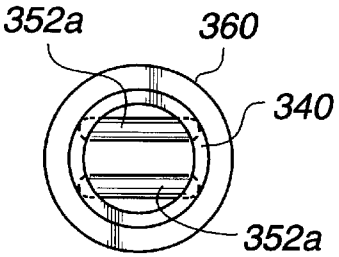
FIG. 9B is a front axial view of the third embodiment of the present invention.

FIG. 8 shows a retaining member 340 according to a third embodiment of the present invention. Similar to the retaining members described above according to the other embodiments of the present invention, the retaining member 340 is adapted to be placed on the first end of and in surrounding relation to the driving bit member 220. The retaining member 340 has a shape of an elongated cylinder with a hollow interior. The retaining member 340 includes a first elongated body 346, a neck 344 extending from the first elongated body 346 and a second elongated body 342 extending from the neck 344. The first elongated body 346 has at least two receptacles 354*a* and 354*b* for holding pins 352*a* and 352*b*. In particular, the receptacle 354*a* is sized and adapted so that the length of the pin 352, at its at-rest position, will not protrude outside the outer circumference of the first elongated body 346 (also see FIG. 9B). Similarly, the receptacle 354*b* is sized the same way for the pin 352*b*. The receptacles 354*a* and 354*b* are positioned, for example, opposite to each other so that the pins 352*a* and 352*b*, when they are at their at-rest position, are a substantially parallel to each other, as shown in FIG. 9B. In an alternative embodiment, three receptacles configured triangularly around the first elongated body 346 may be used with three pins to hold the screw.

The neck 344 which extends from the first elongated body 346 is constructed substantially similar to the neck of the above described retaining members according to the other embodiments of the present invention. Thus, for the sake of brevity, a detailed description thereof will be omitted here. The second elongated body 342 of the retaining member 340 defines an opening which is adapted to receive a cylindrical plug 80 shown in FIG. 3A. The description of the cylindrical plug 80 is described above with respect to FIG. 3A, and thus will not be repeated here.

Figure 9A:
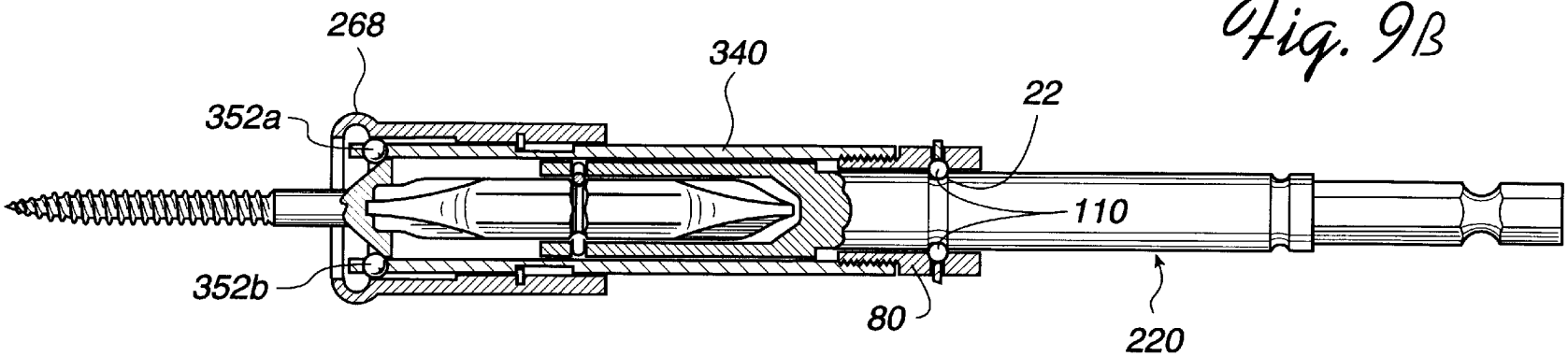
FIG. 9A is a cross-sectional view of the third embodiment of the present invention.

The operation of the fastener holding device according to the third embodiment will now be discussed. As shown in FIG. 9A which illustrates a cross sectional view of the second embodiment of the fastener holding device, the protuberance 34 of the retainer ring 32 (see FIG. 2) holds the driving bit 100 firmly into the first portion 26 of the driving bit member 220. The retaining member 240 is slidably coupled to the driving bit member 220 by a pair of ball bearings 110. In particular, the ball bearings 110, which are mounted in the plug 80, engage the first ring 22 of the driving bit member 220. The sleeve member 260 is then slidably coupled to the retaining member 340 with an inner retaining ring 208 engaging the neck 344 of the retaining member 340.

To place a screw onto a driving bit 100, the sleeve member 360 is pulled back relative to the retaining member 340. When the sleeve member 360 is sufficiently pulled back, the ring shaped member 268 (FIG. 6B) is positioned immediately next to the pins 352*a* and 352*b*. As a result, the pins 352*a* and 352*b* are free to pushed out from the receptacles 354*a* and 354*b*, allowing the screw head to be inserted onto the driving bit 100. Once the screw is properly positioned on the driving bit 100, the sleeve member 360 is pushed toward the screw which in effect causes the pins 352*a* and 352*b* to firmly hold the screw.

As the screw is driven into the work piece, the sleeve member 360 gets closer to the work piece. When the sleeve member 360 makes a contact with the work piece, the force of the driving bit member 220 continues to force the screw into the work piece, while the sleeve member 360 is gradually pulled backwards. The backward movement of the sleeve member 360 causes the pins 352*a* and 352*b* to drop into the groove 266 of the ring shaped member 268, thus further allowing the screw to penetrate into the work piece until the screw is completely embedded.

FIG. 9B illustrates a front axial view of the third embodiment of the present invention. The pins 352*a* and 352*b* partially protrudes toward the center axis of the retaining member 340. This construction allows the screw to be held in between the pins 352*a* and 352*b*.

Figure 10:
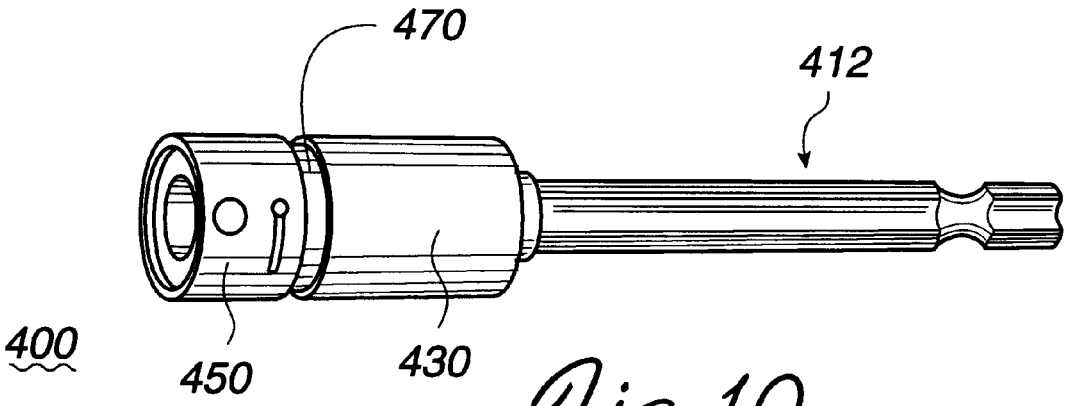
FIG. 10 is a perspective view of a fourth embodiment of the present invention.
Figure 11A:
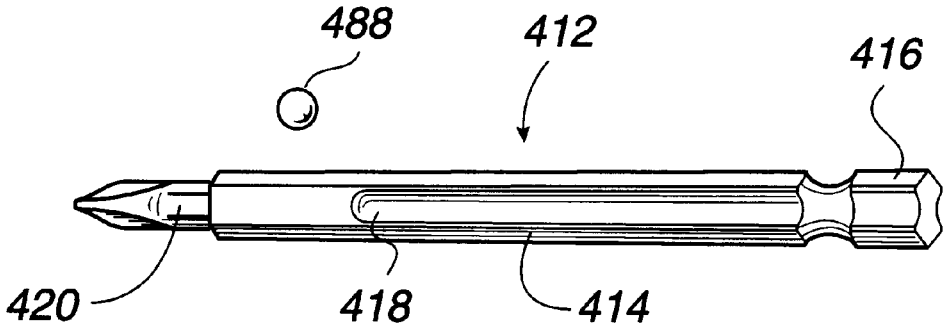
FIGS. 11A and 11B illustrate various types of driving bits for use in the fourth embodiment of the present invention.
Figure 11B:
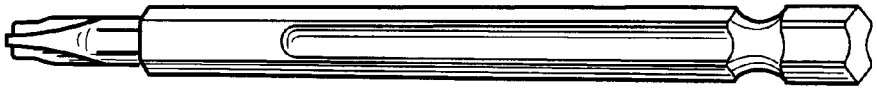

FIG. 10 illustrates a perspective view of a fourth embodiment of the present invention. The device includes a driving bit member 412, a retaining member 470, a first sleeve member 450 and a second sleeve member 430. As shown in FIGS. 11A and 11B, the driving bit member 412 includes an elongated member 414 which is polygonally shaped around the circumference, a similarly shaped base 416 and a driving tip 420. The base 416 is sized and adapted to be used with power or manual tools and is polygonally shaped to prevent slipping. The elongated member 414 has at least one elongated groove 418 having, preferably, a semi-circular cross section sized to fit a ball bearing 488 (see FIG. 12). The driving tip 420 may be formed of any size and shape to accommodate various types of screws (e.g., see FIG. 11B). The driving bit 412 may be formed of any resilient material, such as tempered steel, etc.

Figure 12:
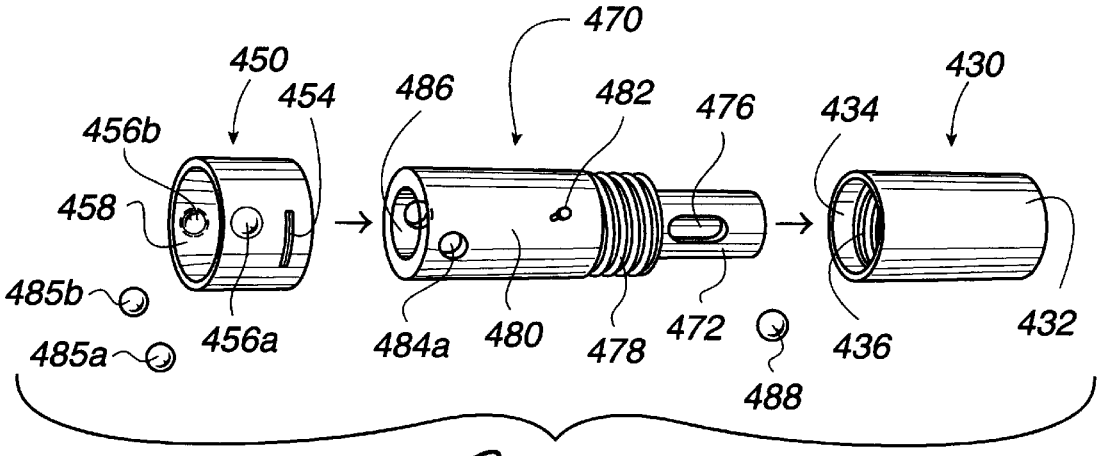
FIG. 12 is an exploded view of the fastener holding device (without the driving bit) according to the fourth embodiment of the present invention.

FIG. 12 illustrates an exploded view of the fourth embodiment of the fastener holding device without the driving bit 412. The retaining member 470 is preferably adapted to be slidably mounted on the front end (the opposite end of the base 416) of and in surrounding relation to the driving bit member 412. The retaining member 470 has a shape of an elongated cylinder with a hollow interior for inserting the driving bit member 412 therethrough. The retaining member 470 preferably includes an elongated body 480, at least two receptacles 484*a* and 484*b* for ball bearings 485*a* and 485*b*, a control screw 482 partially penetrating the elongated body 480 from the outside, a threaded portion 478 for receiving the second sleeve member 430, and an elongated tail portion 472 defining an elliptical opening 476 sized to fit a retaining ball bearing 488. The receptacles 484*a* and 484*b* are sized and configured so that the ball bearings 485*a* and 485*b*, when installed in the receptacles of 484*a* and 484*b*, will protrude through the opening in the inner wall of the retaining member 470 without completely passing through the same. In other words, the ball bearings 485*a* and 485*b* can only be installed from the outside wall of the retaining member 470, because the opening diameter of the receptacles 484*a* and 484*b* on the outer surface of the retaining member 470 is larger than that of the inner surface of the retaining member 470.

Further shown in FIG. 12 is the first sleeve member 450 which includes a slit 454 for guiding the control screw 482. The slit 454 is formed around the sleeve member 450 and is positioned so that when the sleeve member 450 is installed on the retaining member 470, the location of the control screw 482 coincides with that of the sleeve member 450.

Figure 13:
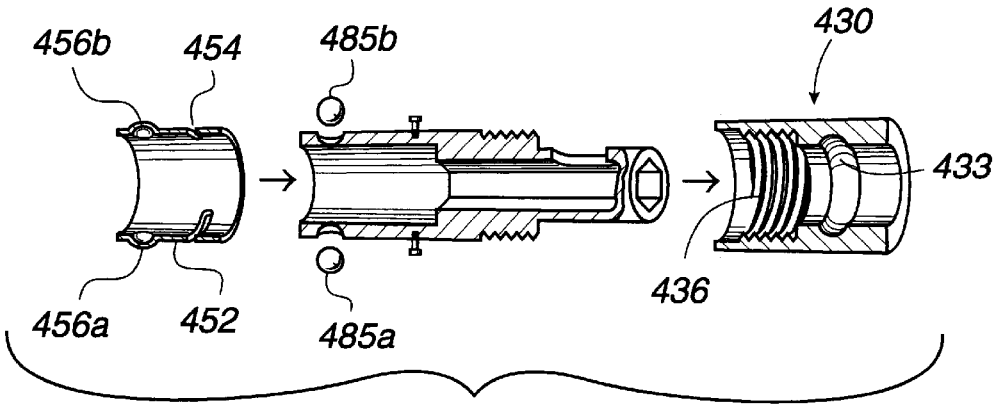
FIG. 13 is a cross-sectional view of FIG. 12.

The first sleeve member 450 also includes a semicircular protrusions 456*a* and 456*b* formed on the outer surface of the sleeve member 450 to define a concave surface on the opposite side of each protrusion, as shown in FIG. 13. Moreover, each protrusion is preferably formed on the opposite side of each other. The protrusions 456*a* and 456*b* are sized to fit the ball bearings 485*a* and 485*b*. The sleeve member 450 may be formed of any rigid materials, such as steel, etc.

FIG. 12 further illustrates the second sleeve member 430 adapted to be placed on and in surrounding relation to the retaining member 470. The second sleeve member 430 has a body 432 which is an elongated cylinder with a hollow interior with openings on each end of the cylinder. The inner surface of the body 432 of the second sleeve member 430 has a mating threaded portion 436 for coupling with the threaded member 478 of the retaining member 470. Around the inner circumference of the body 432 of the sleeve member 430, there is an inner groove 433, as shown in FIG. 13. The inner groove 433 is sized and configured to be fitted with a retainer ball 488. The retainer ball 488 is constructed of a resilient material, such as steel, and is substantially circular. The second sleeve member 430 can be adjusted with respect to the retaining member 470 to accommodate fasteners having head portions of various configurations and sizes.

The assembly of the embodiment of FIGS. 10–12 are as follows. The driving bit 412 of FIG. 11A is installed into the hollow interior of the retaining member 476. After the elliptical opening 476 is positioned substantially above the elongated groove 418 of the driving bit 412, the retainer ball 488 is dropped into the elliptical opening 476. The second sleeve member 430 is then screwed onto the retaining member 476 until the retainer ball 488 engages the inner groove 433 of the second sleeve member 430. The second sleeve member 430 and the retainer ball 488 acts together to prevent the driving bit 412 from moving with respect to the retaining member 470. Then, the ball bearings 485*a* and 485*b* are installed into the receptacles 456*a* and 456*b*. The first sleeve member 450 is then slidably installed onto the front end of the retaining member 470. Upon aligning the slit 454 with the opening for a control screw 482, the control screw 482 is inserted to prevent the first sleeve member 450 from sliding off of the retaining member 470. This construction allows the first sleeve member 450 to move freely in the axial direction in relation to the retaining member 470, except the axial movement of the first sleeve member 450 is limited to the length of the slit 454. The first sleeve member 450, the retaining member 470 and the second sleeve member 430 may be slid away from the driving tip 420 of the driving bit member 412 so that the fastener holding assembly can be sued as a conventional screw driver.

The operation of the embodiment shown in FIG. 10 is similar to that of FIG. 5. As shown in FIG. 13, which illustrates a cross section view of the embodiment of FIG. 12, to place a screw onto a driving bit 412, the first sleeve member 450 is rotated until the semicircular protrusions 456*a* and 456*b* are immediately above the ball bearings 485*a* and 485*b*. As a result, the ball bearings 485*a* and 485*b* partially fall out of the receptacles 484*a* and 484*b*, allowing the screw head to be inserted onto the driving bit 412. Once the screw is properly positioned on the driving bit 412, the first sleeve member 450 is rotated in the reversed direction, which in effect causes the ball bearings 485*a* and 485*b* to firmly hold the screw.

As the screw is driven into the work piece, the first sleeve member 450 gets closer to the work piece. When the first sleeve member 450 makes a contact with the work piece, the force of the driving bit 412 continues to drive the screw into the work piece, while the first sleeve member 450 remains substantially still, since it is pushed against the work piece. As the retaining member 470 rotates with respect to the first sleeve member 450, the protrusions 456*a* and 456*b* line up with the ball bearings 485*a* and 485*b* and causes the ball bearings 485*a* and 485*b* to drop into the protrusions 456*a* and 456*b*, thus causing the screw to penetrate into the work piece until the control screw 482 reaches the end of the slit 454. This embodiment is useful when an operator does not want the screw to be completely embedded into the work piece. Thus, the penetration into a work piece can be controlled by the size of the slit 454 and/or the length of the first sleeve member 450.

Figure 14:
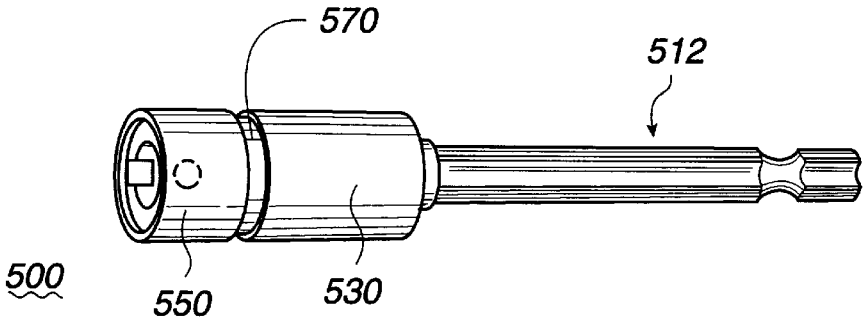
FIG. 14 is a perspective view of a fifth embodiment of the present invention.
Figure 15:
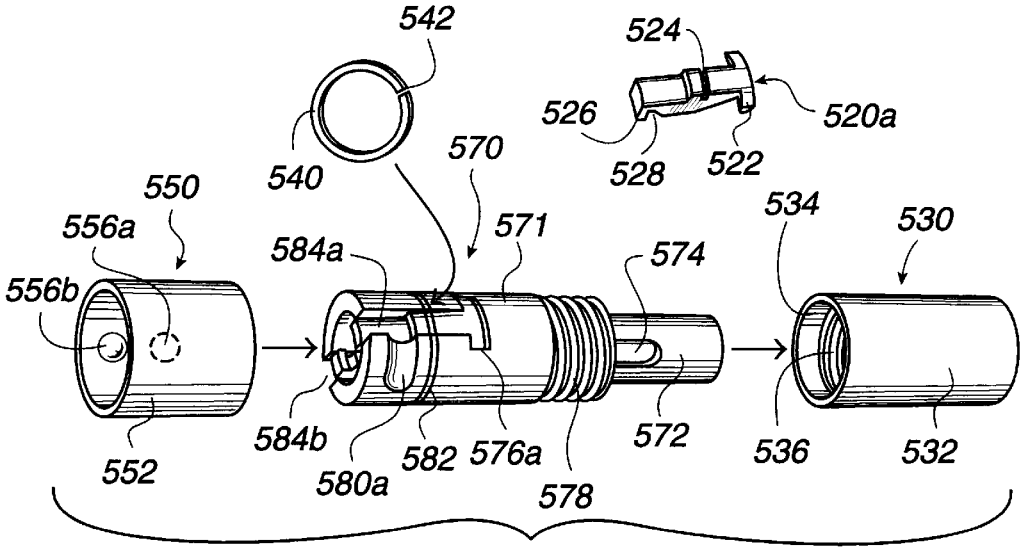
FIG. 15 is an exploded view of the fifth embodiment of the present invention without the driving bit.
Figure 16:
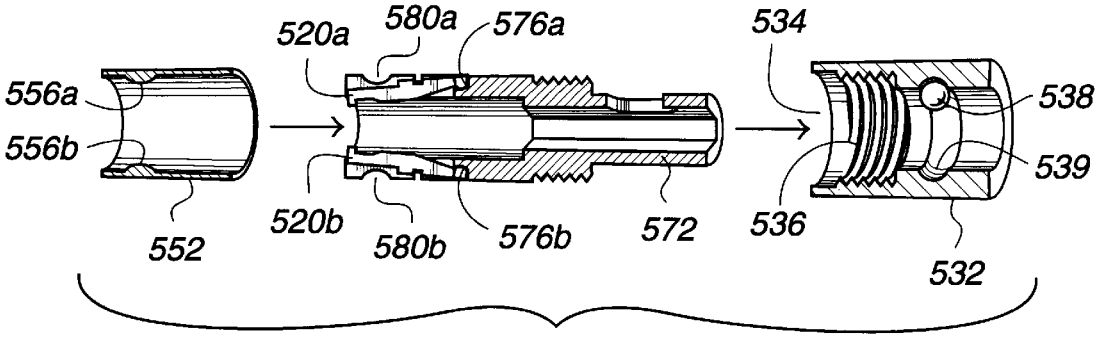
FIG. 16 is a cross-sectional view of FIG. 15.

The embodiment of FIGS. 14–16 will now be discussed. As shown in FIGS. 14 and 15, the second sleeve member 530 is identical to the second sleeve member 430 shown in FIG. 12, and thus, for the purpose of brevity, the detailed description will be omitted. The retaining member 570 has slots 576*a* and 576*b*, each slot formed on opposite side of the body 571. Each slot is sized to fit a bracket 520*a*. The retaining member 570 further includes a groove 582 formed around the outer circumference of the body 571 which is sized and configured to receive a retainer ring 540. As shown in FIG. 15, the retaining member 570 further includes two recesses 584*a* and 584*b*, in which each recess is sized to fit a bracket 520*a*. The pivot member 522 of the bracket 520*a* is placed onto the slot 576*a* of the retaining member 570 and is held in place by the retaining ring 540. The retaining ring 540 has a break portion 542 and is made of a stiff but flexible material to allow easy compression and expansion. Once the bracket 520*a* is properly positioned into the slot 576*a*, the groove 582 of the retaining member lines up with the groove 524 of the bracket 520*a*, thus allowing the retainer ring 540 to be fitted into both grooves 582 and 524.

The retaining member 570 also includes a first conduit 580*a* for guiding a first protruding member 556 of the first sleeve member 550. The first conduit 580*a* is formed approximately one-fourth of the outer circumference of the body 571 and is sized to fit the protruding member 556. There is also provided a second conduit 580*b* on the opposite side of the first conduit 580 for the second protruding member 556*b*.

The first sleeve member 550 shown in FIG. 15 includes semicircular protrusions 556*a* and 556*b* formed on the inner surface of the sleeve member 450. Each protrusion is preferably formed on the opposite side of each other. The protrusions 556*a* and 556*b* are sized to fit the corresponding conduits 580*a* and 580*b*. The sleeve member 550 may be formed of any rigid materials, such as steel.

As described above, FIG. 15 further illustrates a T-shaped bracket 520*a* which includes a pivot member 522 sized to pivotally fit into the slot 576*a*. The bracket 520*a* also has a substantially perpendicular projection 526 forming an indentation 528 which is used for holding the head of a screw. It is preferable that the retaining member 570 has two recesses 584*a* and 584*b* for use with two brackets 520*a* and 520*b*, in which 520*b* is identical to bracket 520*a*.

The operation of the embodiment shown in FIGS. 14–16 will now be described. As shown in FIG. 16, which illustrates a cross section view of the embodiment of FIG. 15, to place a screw onto a driving bit 412, the first sleeve member 550 is rotated until the semicircular protrusions 556*a* and 556*b* are moved away from the recesses 584*a* and 584*b*. As a result, two brackets 520*a* and 520*b* can be pivoted away from the center axis at the slots 576*a* and 576*b*, thus allowing the screw head to be inserted onto the driving bit 412. Once the screw is properly positioned on the driving bit 412, the first sleeve member 550 is rotated in the reversed direction so that the protrusions 556*a* and 556*b* are placed on each respective brackets which in effect cause the brackets 520*a* and 520*b* to firmly engage the screw.

As the screw is driven into the work piece, the first sleeve member 550 gets closer to the work piece. When the first sleeve member 550 makes a contact with the work piece, the force of the driving bit 412 continues to drive the screw into the work piece, while the first sleeve member 550 remains still since it is pushed against the work piece. As the retaining member 570 rotates with respect to the first sleeve member 550, the protrusions 556*a* and 556*b* rotate away from the bracket within the path 580*a* and 580*b*. This causes the brackets 520*a* and 520*b* to disengage the screw, thus causing the screw to penetrate into the work piece until the protrusions 556*a* and 556*b* reach the end of conduits 580*a* and 580*b* away from the brackets 520*a* and 520*b*. This is useful when an operator does not want the screw to be completely embedded into the work piece.

Figure 17:
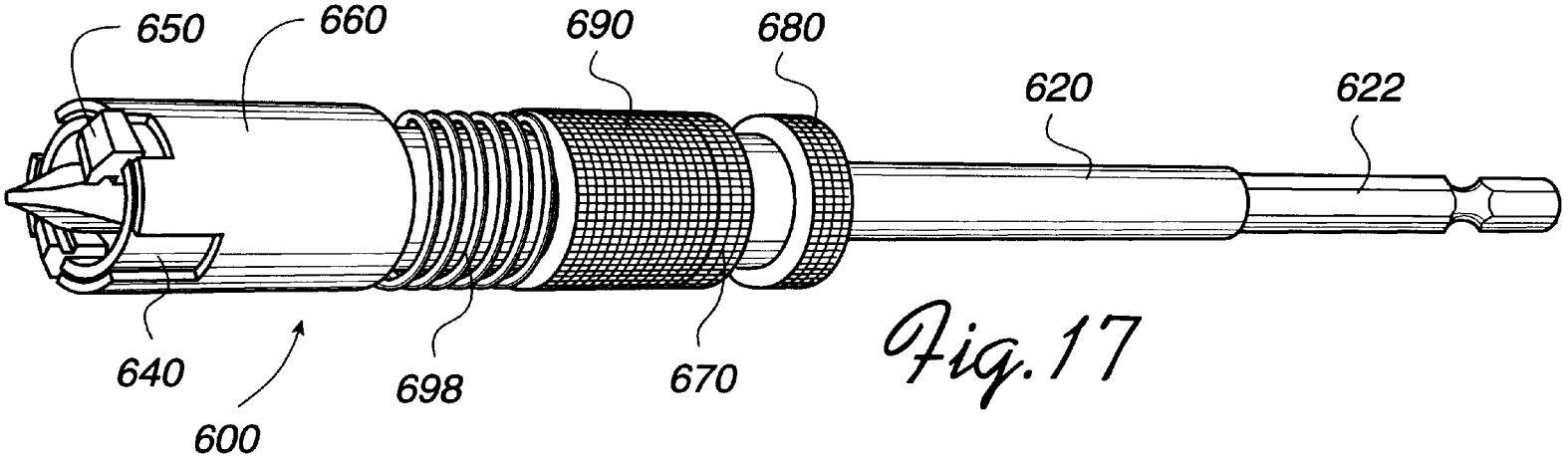
FIG. 17 is a perspective view of a sixth embodiment of the present invention.
Figure 18A:
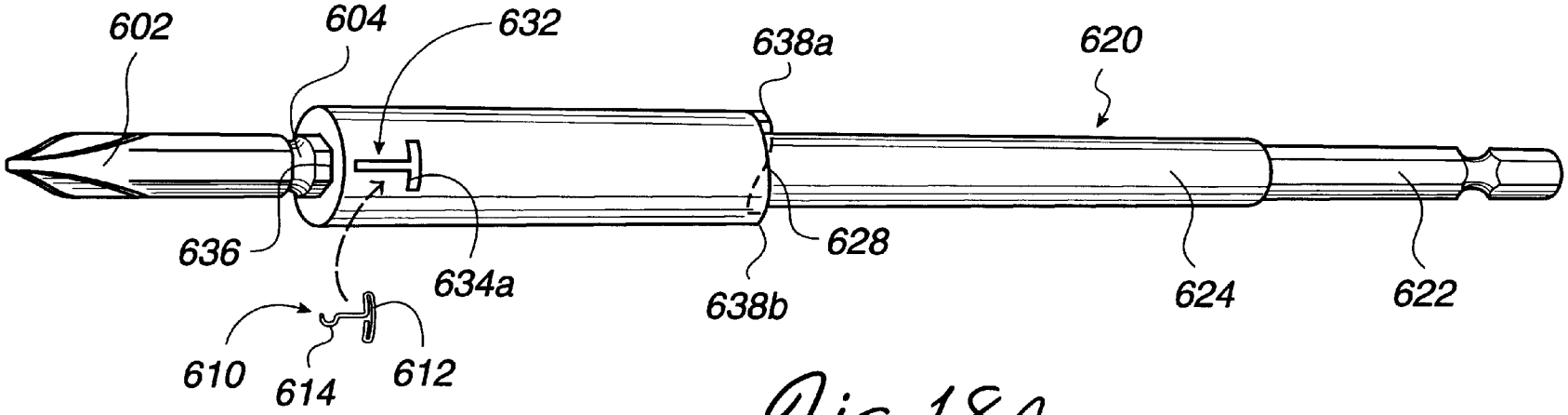
FIG. 18A is a perspective view of a driving bit member according to the sixth embodiment.
Figure 18B:
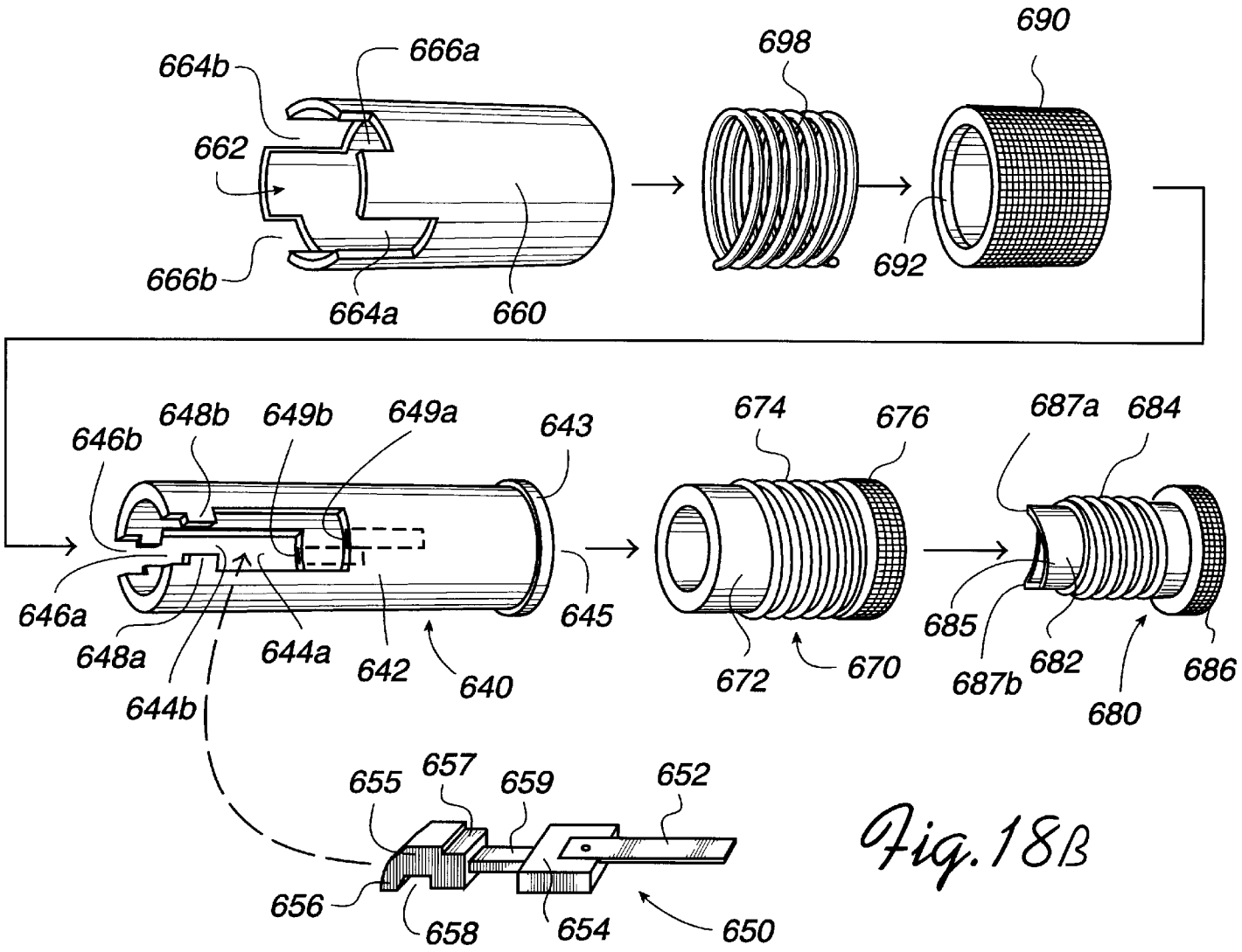
FIG. 18B is an exploded view of the sixth embodiment of the present invention without the driving bit.

FIGS. 17–18B illustrate a sixth embodiment of the fastener holding device 600 which includes a driving bit member 620, a retaining member 640, an engaging assembly 650, a sleeve member 660, a first holding member 690, a second holding member 670, and a plug 680. The retaining member 640 is adapted to be fitted with the driving bit member 620. As shown in FIG. 18A, the driving bit member 620 is an elongated cylindrical member, in which a first portion 630 is adapted to be used with a driving bit 602. An elongated middle portion 624 is axially attached to the first portion 630 and is connected a third portion 622, thus forming the driving bit member 620.

As shown in FIG. 18A, the first portion 630 has a polygonally shaped aperture 636 for receiving the driving bit 602. To hold the driving bit 602 firmly within the first portion 630 of the driving bit member 620, a retainer assembly 610 is used. The retainer assembly 610 is placed into a T-shaped slit 632 formed on the outer surface of the first portion 630. The T-shaped slit 632 has a leg portion 634*b* which forms a passage from the outer surface to the inner surface of the first portion 630. A head portion 634*a* of the slit 632 does not penetrate the wall of the first portion 630 of the driving bit member 620. The retainer assembly 610 preferably has a pivot portion 612 which is placed into the head portion 634*a*, and an engaging portion 614 which is placed into the leg portion 634*b* of the slit 632. The engaging portion 614 of the retainer assembly 610 engages the neck 604 of the driving bit 602 when the driving bit 602 is installed within the first portion 630. When the driving bit 602 is pushed into the aperture 636, the body of the driving bit 602 pushes the engaging portion 614 of the retainer assembly 610 slightly outward. When the driving bit 602 is further pushed into the first portion 630, the engaging portion 614 engages the neck 604 and retains its original form. The first portion 630 of the driving bit member 620 is adaptable for a rapid change of screw driver bit sizes or styles, and thus is capable of accommodating screws of a variety of sizes and head shapes. In an alternatively embodiment of the present invention, the first portion 630 and the driving bit 602 may be integrated into one component.

The first portion 630 also includes an inclined surface 628 and an edge 638*a* which are shaped and sized to fit with the similar construction of the plug 680. The purpose and function of the inclined surface 628 and the edge 638*a* will be described later.

The middle portion 624 of the driving bit member 620 is an elongated cylindrical member which extends from the first portion 630. The third portion 622 of the driving bit member 620 extends from the middle portion 624. The third portion 622 is of a polygonal shape around its circumferential surface and is adapted to be used with power or hand tools. According to this embodiment of the present invention, the first 630, the middle 624 and the last portions 622 of the driving bit member 620 may be formed together as one mold or may be formed from separate portions coupled together by welding or the like. The driving bit member 620 may be made of any rigid material, preferably tempered steel.

FIG. 18B illustrates a retaining member 640, which is configured to be placed on the first end of and in surrounding relation to the driving bit member 620, a first holding member 690, a second holding member 670, and a plug 680. In the embodiment, the first holding member 690 is an elongated cylindrical member sized to slidably fit around the retaining member 640 and configured to engage the second holding member 670. The first holding member 690 includes a first inner collar 692 which forms a smaller opening than the other end of the first holding member 690 and an inner thread (not shown) for mating with the corresponding thread 674 of the second holding member 670. When the first holding member 690 is inserted onto the retaining member 640, the inner collar 692 of the first holding member 690 engages the collar 643 of the retaining member 640.

The second holding member 670 has an elongated cylindrical member 672 which has an outer thread 674 for coupling with the first holding member 690 and a second inner thread (not shown) for coupling with the plug 680. The outer thread 674 is configured to fit the first inner thread of the first holding member 690 to rigidly hold the retaining member 640 between the first 690 and the second 670 holding members.

The plug 680 includes a base 686, a neck 682 and a threaded member 684 extended from the base 82. The outer diameter of the threaded member 684 is sized to fit within the inner surface of the second holding member 670. The neck 682 of the plug 680 defines an opening in which the second portion 624 of the driving bit member 620 is slidably inserted. The neck 682 of the plug 680 includes an inclined surface 685 which has substantially the same incline angle as the incline surface 628 of the first portion 630. The neck 682 also has at least two edges 687*a* and 687*b*, preferably at the opposite ends so that each edge abuts against respective edges 638*a* and 638*b* of the first portion 630 of the driving bit member 620.

The inclined surface 685 of the plug 680 and the inclined surface 628 of the driving bit member 620 are adapted to slide against each other to adjust the distance between the driving bit 602 and the groove 658 of the bracket 650. As a result, a fastener of various head thickness can be used with the present embodiment. For example, depending on the thickness of the head of a screw, the gap between the both inclined surfaces 682 and 628 will be adjusted accordingly. As the driving bit member 620 rotates to drive the screw, the plug 680 and the driving bit member 620 firmly engage the screw.

The retaining member 640 is an elongated cylinder with a hollow interior. The retaining member 640 includes a collar 643 formed around one end of the retaining member 640. Preferably, the retaining member 640 has a lower receptacle 644a and an upper receptacle 646a for receiving the bracket 650. A second bracket identical to the bracket 650 is placed into a lower receptacle 644*b* and an upper receptacle 646*b*. The retaining member 640 further includes a pair of slots 649*a* and 649*b* formed within the body of the retaining member 640 and configured to received the bracket 650.

FIG. 18B also illustrates various components which form an engaging assembly of the fastener holding device 10 according to the sixth embodiment of the present invention. The engaging assembly includes a pair of brackets (only one is shown as 650, because both are symmetrically shaped). The bracket 650 has a head 655, a connector 659 connected to the head, a body 654 extending from the connector 659 and a leg 652 extending from the body 654. The bracket 650 further has a neck 657 for coupling either a shorter recess 666*a* or a longer recess 664*a* of the sleeve member 60 (a detail description is provided below). There is provided on the head 655 a groove 658 for engaging the head of a screw. The leg 652 is formed of a flexible, yet rigid, material so that the other members of the bracket 650 pivot with respect to the leg 652 when the leg 652 is installed into the slot 649*a*.

Preferably, the bracket 650 is semicircularly shaped and is adapted to be placed into the lower 644*a* and the upper 646*a* receptacles. In particular, the leg 652 of the bracket 650 is inserted into the slot 649*a* of the retaining member 640, the body 654 is positioned in the lower receptacle 644*a*, the connector 659 is placed in between a gap formed by projections 648*a* and 648*b*, and the head 655 is placed into the upper receptacle 646*a*.

FIG. 18B further illustrates a sleeve member 660 and a coil 698 configured to be placed on and in surrounding relation to the retaining member 640, in which the coil 698 is placed between the sleeve member 660 and the first holding member 690. The coil 698 is placed between the sleeve member 660 and the first holding member 690 to push the sleeve member 660 away from the first holding member 690. The coil 698 is made of any rigid material, such as steel. The sleeve member 660 is an elongated cylinder with a hollow interior with openings on each end of the cylinder. The sleeve member's 660 inner diameter is slightly larger than the outer diameter of the retaining member 640 for sliding and rotating in relation to the retaining member 640. The sleeve member 660 has a pair of short recesses 666*a* and 666*b* and a pair of long recesses 664*a* and 664*b*. Each one of the short recesses 666*a* and 666*b* are situated opposite of each other. Similar, each one of the long recesses 664*a* and 664*b* are situated opposite of each other. In the preferred embodiment, all four recesses are evenly placed around one end of the sleeve member 660, and are configured to accommodate the head 655 of the bracket 650. The purpose of the differently sized recesses is discuss below with regard to the operation of the present invention.

The operation of the fastener holding device according to the sixth embodiment will now be discussed. As shown in FIGS. 18A and 18B, the engaging portion 614 of the retainer assembly 610 holds the driving bit 602 firmly into the first portion 630 of the driving bit member 620. The first holding member 690 is slidably placed onto the retaining member 640 and engages the second holding member 670, in which the first holding member 690 screws onto the matching thread 674 of the second holding member 670. In turn, the plug 680 screws into the inner surface of the second holding member 670. The bracket 650 is installed into the lower 644*a* and the upper 646*a* receptacles. Another bracket of the same shape (not shown) is installed into the corresponding receptacles 644*b* and 646*b*. After placing the coil 698 onto the retaining member 640, the driving bit member 620 is inserted into the retaining member 640. The sleeve member 660 is then placed around the retaining member 640 until two oppositely positioned recesses, either short recesses 666*a* or long recesses 664*a*, rest immediately below the head 655, as shown in FIG. 18. The head 655 of the bracket 650 prevents the sleeve member 660 from separating away from the retaining member 640 due to the force of the coil 698.

To place a screw onto a driving bit 602, the sleeve member 660 is pulled back relative to the retaining member 640. When the sleeve member 660 is sufficiently pulled back with respect to the retaining member 640, the brackets 650 can be flexed outward to receive a fastener, such as a screw. After the groove 658 of the bracket 650 engages the head portion of the screw, the sleeve member 660 slides up toward the bracket 650 until the neck 657 is fitted into the shorter recess 666*a* or the longer recess 664*a*. Because the sleeve member 660 surrounds the brackets by the neck 657, the brackets cannot not be moved outwardly, and thus holds the screw firmly onto the driving bit 602.

The fastener holding device according to the sixth embodiment, as shown in FIG. 17, operates in two different modes. In a first mode, the long recess 664*a* of the sleeve member 660 is used with the bracket 650, in which the sleeve member 660 makes a contact with a work piece before the head 655 of the bracket 650 makes contact with the work piece. When the sleeve member 660 is pushed against the work piece, the sleeve member 660 moves toward the first holding member 690, where the head 655 of the bracket 650 is exposed, thus allowing the bracket 650 to disengage the screw before the screw is completely embedded in the work piece. Therefore, the use of the long recess 664*a* is encouraged to minimize damages to the surface of the work piece or to control the depth of penetration into the work piece. In a second mode, the short recess 666*a* of the sleeve member 660 is used, in which the head 655 first makes contact with the work piece, thus allowing the screw to be penetrated deeper into the work piece. In the second mode, the bracket 650 disengages the screw when the screw is substantially driven into the work piece.

Figure 19:
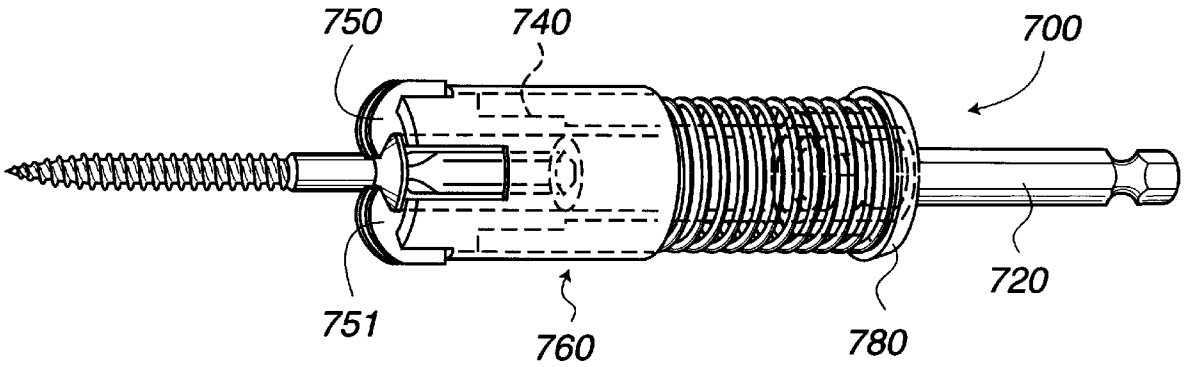
FIG. 19 is a perspective view of a seventh embodiment of the present invention.
Figure 20:
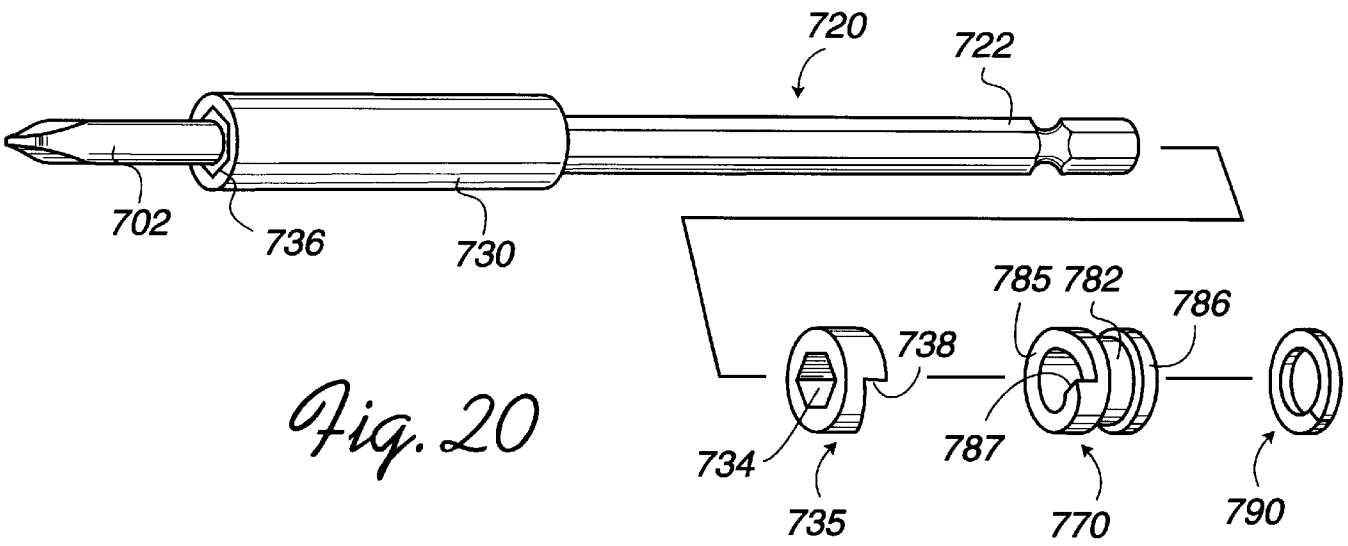
FIG. 20 is a perspective view of a driving bit member according to the seventh embodiment.

FIGS. 19–22 illustrate a seventh embodiment of the fastener holding device 700 which includes a driving bit member 720, a retaining member 740 having an engaging assembly comprising a pair of clamps 750 and 751, a sleeve member 760 and a plug 780. The retaining member 740 is adapted to be fitted with the driving bit member 720. As shown in FIG. 20, the driving bit member 720 has an elongated cylindrical first portion 730 which has a cylindrical outer surface and is adapted to be used with a removable driving bit 702. A polygonally shaped elongated second portion 722 is axially connected to the first portion 730, thus forming the driving bit member 720.

As shown in FIG. 20, the first portion 730 has a polygonally shaped aperture 736 for receiving the driving bit 702 having a similarly constructed external body. The first portion 730 of the driving bit member 720 is adaptable for easily changing screw driver bits having various sizes or head shapes. In an alternatively embodiment of the present invention, the first portion 730 and the driving bit 702 may be integrated into one component.

Abutted against the end of the first portion 730 is a first end piece 735 having a gradually inclined surface 728. In particular, the first end piece 735 has an inclined surface 728 and an edge 738 which are shaped and sized to fit with the similarly constructed second end piece 770. The first end piece 735 has a polygonally shaped axial aperture 734 to fit the similarly shaped elongated second portion 722 of the driving bit member 720.

The second end piece 770 includes a base 786 and a neck 782 extending from the base 786. The outer diameters of the first end piece 735 and the second end piece 770 are sized to fit within the inner surface of the retaining member 740. The neck 782 defines a cylindrical opening in which the second portion 722 of the driving bit member 720 is slidably inserted. Due to the shape of the cylindrical opening of the neck 782, the second end piece 770 rotates independent of the rotational movement of the driving bit member 720, while the first end piece 735 rotates with the driving bit member 720. The neck 782 of the second end piece 770 includes an inclined surface 785 which has substantially the same incline angle as the incline surface 728 of the first end piece 730. The neck 782 also has an edge 787 so that it abuts against the edge 738 of the first end piece 735.

The inclined surface 785 of the second end piece 770 and the inclined surface 728 of the first end piece 735 are adapted to slide against each other to adjust the distance between the driving bit 702 and the hooks 758*a* and 758*b* of the clamps 750 and 751. As a result, a fastener of various head thickness can be used with the present embodiment. For example, depending on the thickness of the head of a screw, the gap between the both inclined surfaces 785 and 728 will be adjusted accordingly.

Placed behind the second end piece 770 is a washer 790 sized to firmly slide along the length of the second portion 722 of the driving bit member 720. The inner diameter of the washer 790 is about the same as the diameter of the second portion 722 so that the properly installed washer 790 slides along the second portion 722 with some resistance.

Figure 21:
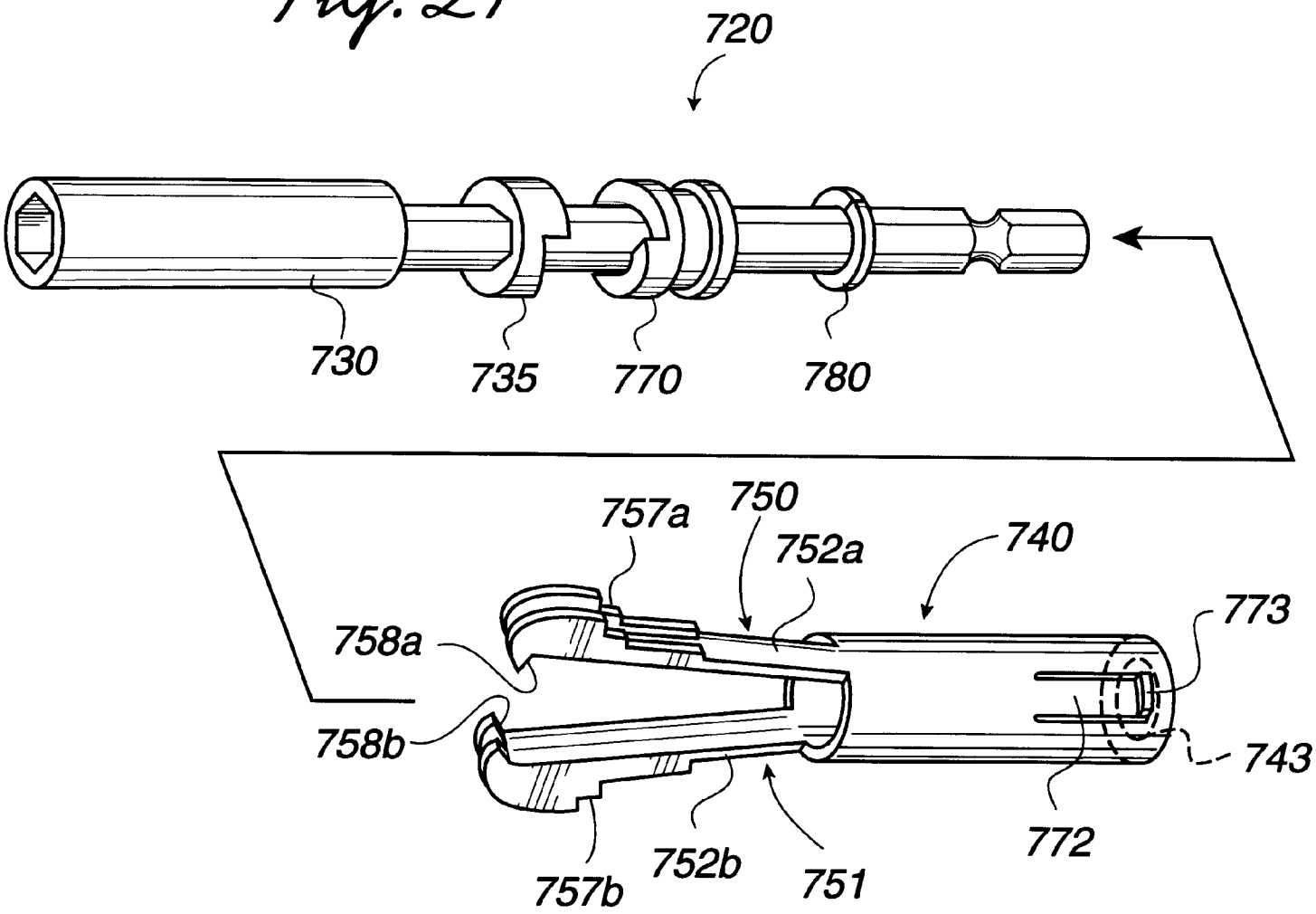
FIG. 21 is a perspective view of a driving bit member and a retaining member.

As shown in FIGS. 20 and 21, the second portion 722 of the driving bit member 720 is of a polygonal shape around its circumferential surface and is adapted to be used with power or hand tools. According to the present invention, the first 730 and second portions 722 of the driving bit member 720 may be formed together as one mold or may be formed from separate portions coupled together by welding or the like. The driving bit member 720 may be made of any rigid material, preferably tempered steel.

FIG. 21 illustrates a retaining member 740, which is configured to be placed on and in surrounding relation to the first portion 730 of the driving bit member 720. The retaining member 740 is an elongated cylinder with a hollow interior. The retaining member 740 includes a collar 743 formed inwardly around one end of the retaining member 740 to define an end aperture sized and configured to slidably receive the second portion 722 of the driving bit member 720. Projecting from the other end of the retaining member 740 are a pair of clamps 750 and 751 used for holding a fastener. The first clamp 750 is identical in shape as the second clamp 751.

The clamps 750 and 751 together form an engaging assembly of the fastener holding device 700 according to the seventh embodiment of the present invention. The first clamp 750 has a leg 752*a*, a hook 758*a* for holding the fastener and a neck 657 for coupling either shorter recesses 766*a*, 766*b* or longer recesses 764*a*, 764*b* of the sleeve member 760. The leg 752*a* is formed of a flexible, yet rigid, material so that the clamps 750 and 751 pivot with respect to the retaining member 740.

Adjacent to the collar 743 of the retaining member 740, there is an inward protrusion 772 for engaging the neck 782 of the second end piece 770 and an outward protrusion 773 for engaging the plug 780. Preferably, there are two inward protrusions 772 and outward protrusions 773 on opposite sides of the retaining member 740. The retaining member 740 is slidably inserted on the driving bit member 720 thereby pushing the washer 790, second end piece 770 and first end piece 735 against the first portion 730 of the driving bit member 720. Because the inner protrusion 772 is flexible, it will slightly bend outward until the inner protrusion 772 engages the second end piece 770. The retaining member is preferably made with a rigid and durable material, such as plastic or steel.

Figure 22:
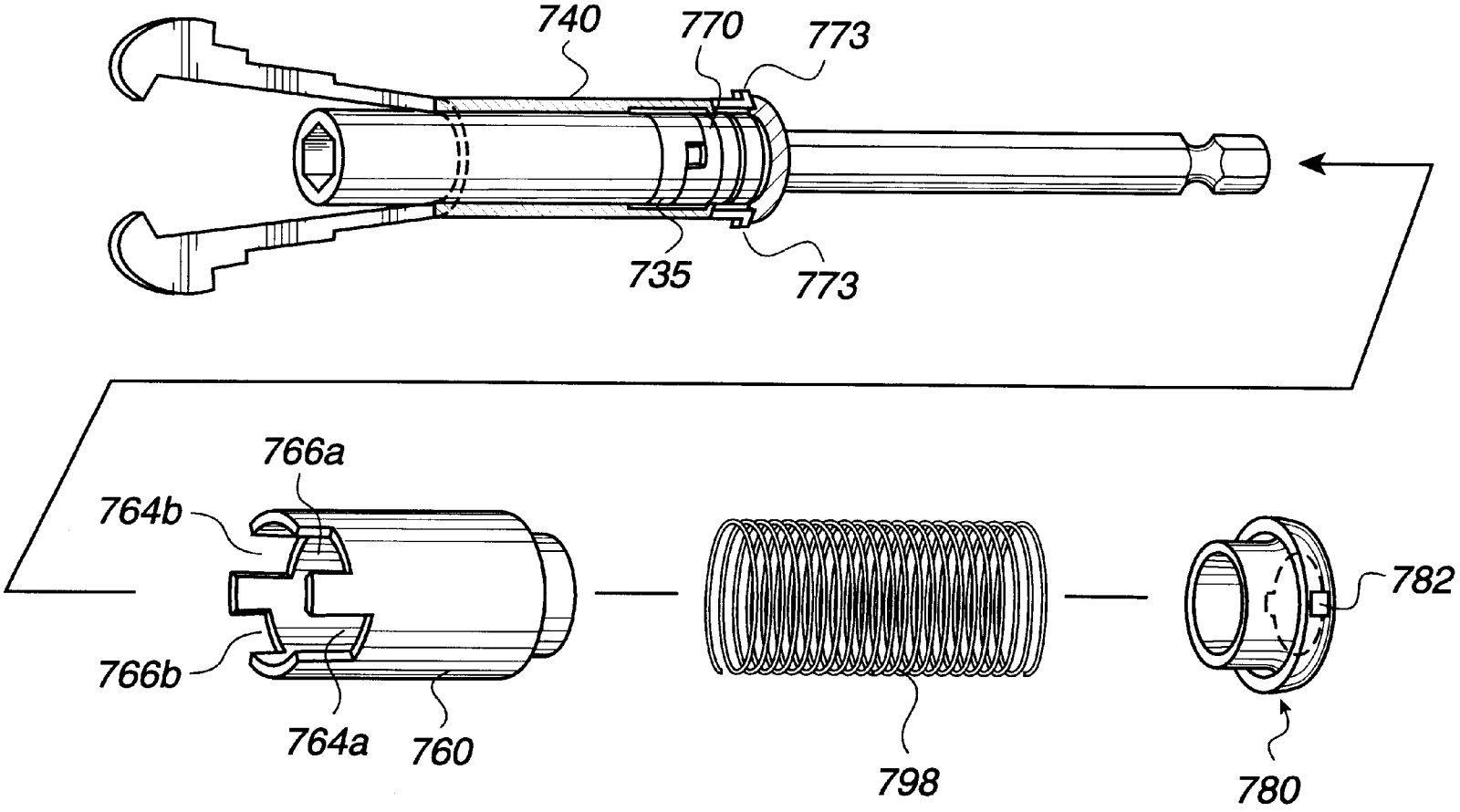
FIG. 22 is an exploded view of the seventh embodiment of the present invention without a driving bit.

FIG. 22 illustrates an assembled representation of the retaining member 740 and the driving bit member 720. FIG. 22 further illustrates a sleeve member 760 and a coil 798 configured to be placed on and in surrounding relation to the retaining member 740 between the sleeve member 760 and the plug 780 to bias the sleeve member 760 away from the plug 780. The coil 798 is made of any rigid material, such as steel or plastic.

The sleeve member 760 is an elongated cylinder with a hollow interior with openings on each end of the cylinder. The sleeve member's 760 inner diameter is slightly larger than the outer diameter of the retaining member 740 for sliding and rotating in relation to the retaining member 740. The sleeve member 760 has a pair of short recesses 766*a* and 766*b* and a pair of long recesses 764*a* and 764*b*. Each one of the short recesses 766*a* and 766*b* are situated opposite of each other. Similar, each one of the long recesses 764*a* and 764*b* are situated opposite of each other. In the preferred embodiment, all four recesses are evenly placed around one end of the sleeve member 760, and are configured to accommodate the head portion of the clamps 750 and 751. The purpose of the differently sized recesses is discuss below with regard to the operation of the present invention.

Once the sleeve member 760 and the coil 798 are slidably placed on the retaining member 740, the plug 780 is also placed in surrounding relation to the retaining member 740. In particular, a pair of receptacles 782 form in opposite side of the plug 780 engage the similarly situated outward protrusions 773 formed on the retaining member 740.

The operation of the fastener holding device 700 according to the seventh embodiment will now be discussed. To place a screw onto a driving bit 702, the sleeve member 760 is manually pulled back relative to the retaining member 740. When the sleeve member 760 is sufficiently pulled back with respect to the retaining member 740, the clamps 750 and 751 flex outward to receive a fastener, such as a screw. After the hooks 758*a* and 758*b* of the clamps 750 and 751 engage the head portion of the screw, the sleeve member 760 is slid up toward the head portion of the clamps 750 and 751 until the necks 757*a* and 757*b* are fitted into the shorter recesses 766*a*, 766*b* or the longer recesses 764*a*, 764*b*. Because the sleeve member 760 surrounds the clamps 750 and 751 by the necks 757*a* and 757*b*, the clamps 750 and 751 can no longer be flexed outwardly, thus firmly holding the screw against the driving bit 702.

The fastener holding device 700 according to the seventh embodiment, as shown in FIG. 19, operates in two different modes. In a first mode, the long recesses 764*a* and 764*b* of the sleeve member 760 are jointly used with the clamps 750 and 751, in which the sleeve member 760 makes a contact with a work surface before the head of the clamps 750 and 751 makes contact. When the sleeve member 760 is pushed against the work surface, the sleeve member 760 moves toward the plug 780, where the head of the clamps 750 and 751 is exposed, thus allowing the clamps 750 and 751 to disengage the screw before the screw is completely embedded in the work surface. Therefore, the use of the long recesses 764*a* and 764*b* are encouraged to minimize damages to the work surface or to control the depth of penetration. In a second mode, the short recesses 766*a* and 766*b* of the sleeve member 760 is used, in which the head of the clamps 750 and 751 first makes contact with the work surface, thus allowing the screw to be penetrated deeper into the work surface. In the second mode, the clamps 750 and 751 disengage the screw when the screw is substantially driven into the work piece.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A fastener holding device operable with a fastener, the fastener holding device comprising;

a driving bit assembly having a first end and a second end;

a retaining member adapted to be placed on the first end of and in surrounding relation to the driving bit assembly, the retaining member having oppositely disposed clamps extending from the retaining member for releasably holding the fastener; and a sleeve member configured to be placed on and in surrounding relation to the retaining member, the sleeve member having a plurality of recesses formed in a forward end of the sleeve member, each one of the plurality of recesses configured to retain the clamps, the sleeve member maintaining at least one of a first position and a second position relative to the retaining member, wherein the clamps engage the fastener when the sleeve member is at the first position and disengages the fastener when the sleeve member is at the second position.

2. A fastener holding device according to claim 1, wherein the first end of the driving bit assembly is a socket configured to receive a driving bit.

3. A fastener holding device according to claim 1, wherein a length of each one the plurality of recesses of the sleeve member determines when the clamps disengages the fastener.

4. A fastener holding device according to claim 3, wherein as the length of the recess is longer, the fastener is disengaged from the clamps before the clamps are pushed against a work surface.

5. A fastener holding device according to claim 4, wherein the plurality of recesses includes at least one pair of oppositely disposed recesses, each having a first length.

6. A fastener holding device according to claim 4, wherein the plurality of recesses includes a first pair of substantially oppositely disposed recesses, each having a first length and a second pair of substantially oppositely disposed recesses, each having a second length.

7. A fastener holding device according to claim 1, further comprising a first end piece placed against and rotating with the driving bit assembly, the first end piece having an inclined surface; and a second end piece placed against the first end piece, the second end piece having an inclined surface which frictionally abuts against the inclined surface of the first end piece, wherein the retaining member is coupled to the second end piece to axially move with respect to the driving bit assembly to accommodate fasteners having various head thicknesses.

8. A fastener holding device according to claim 7, further comprising a plug coupled to the retaining member; and a coil positioned in a surrounding relation to the retaining member and between the sleeve member and the plug to bias the sleeve member to be in the first position.

9. A fastener holding device according to claim 1, wherein each one of the clamps includes a leg extending from the retaining member and a hook for engaging the fastener, wherein the leg is radially biased.

10. A fastener holding device operable with a fastener, the fastener holding device comprising:

driving bit assembly means for driving the fastener, the driving bit assembly means having a first end and a second end;

retaining means for releasably holding the fastener, the retaining means adapted to be placed on the first end of and in surrounding relation to the driving bit assembly, wherein the retaining means has oppositely disposed clamps extending from the retaining member for releasably holding the fastener; and sleeve means for controlling the release of the fastener, the sleeve means maintaining at least one of a first position and a second position relative to the retaining means, wherein the clamps engage the fastener when the sleeve member is at the first position and disengages the fastener when the sleeve member is at the second position, and wherein the sleeve means has a plurality of recesses formed in a forward end of the sleeve means, each one of the plurality of recesses configured to retain the clamps.

11. A fastener holding device according to claim 10, wherein a length of each one the plurality of recesses of the sleeve means determines when the clamps disengage the fastener.

12. A fastener holding device according to claim 11, wherein the plurality of recesses includes a first pair of substantially oppositely disposed recesses, each having a first length and a second pair of substantially oppositely disposed recesses, each having a second length.

13. A fastener holding device according to claim 10, further comprising a first end piece placed against and rotating with the driving bit assembly means, the first end piece having an inclined surface; and a second end piece placed against the first end piece, the second end piece having an inclined surface which frictionally abuts against the inclined surface of the first end piece, wherein the retaining means is coupled to the second end piece to axially move with respect to the driving bit assembly means to accommodate fasteners having various head thicknesses.

14. A fastener holding device according to claim 13, wherein a length of each one the plurality of recesses of the sleeve means determines when the clamps disengage the fastener.

15. A fastener holding device according to claim 14, wherein the plurality of recesses includes a first pair of substantially oppositely disposed recesses, each having a first length and a second pair of substantially oppositely disposed recesses, each having a second length.

16. A fastener holding device according to claim 10, wherein each one of the clamps includes a leg extending from the retaining means and a hook for engaging the fastener, wherein the leg is radially biased.

17. A fastener holding device according to claim 16, wherein a length of each one the plurality of recesses of the sleeve means determines when the clamps disengage the fastener.

18. A fastener holding device according to claim 17, wherein the plurality of recesses includes a first pair of substantially oppositely disposed recesses, each having a first length and a second pair of substantially oppositely disposed recesses, each having a second length.

* * * * *